US009752396B2

(12) United States Patent
Tucken

(10) Patent No.: US 9,752,396 B2
(45) Date of Patent: Sep. 5, 2017

(54) PUSH / PULL SYSTEM AND SUPPORT STRUCTURE FOR SNUBBING UNIT OR THE LIKE ON A RIG FLOOR

(71) Applicant: Brian Tucken, Hazlet (CA)

(72) Inventor: Brian Tucken, Hazlet (CA)

( * ) Notice: Subject to any disclaimer, the term of this patent is extended or adjusted under 35 U.S.C. 154(b) by 264 days.

(21) Appl. No.: 14/451,365

(22) Filed: Aug. 4, 2014

(65) Prior Publication Data

US 2015/0034297 A1 Feb. 5, 2015

Related U.S. Application Data

(60) Provisional application No. 61/862,080, filed on Aug. 4, 2013.

(30) Foreign Application Priority Data

Aug. 5, 2013 (CA) ..... 2823031

(51) Int. Cl.
*E21B 19/02* (2006.01)
*E21B 19/086* (2006.01)
*E21B 19/00* (2006.01)

(52) U.S. Cl.
CPC ..... *E21B 19/086* (2013.01); *E21B 19/00* (2013.01)

(58) Field of Classification Search
CPC ..... E21B 19/086; E21B 19/08
USPC ..... 166/379, 77.1
See application file for complete search history.

(56) References Cited

U.S. PATENT DOCUMENTS

| | | | | |
|---|---|---|---|---|
| 7,090,254 | B1 * | 8/2006 | Pietras | E21B 19/16 166/379 |
| 2010/0193179 | A1 * | 8/2010 | Tucken | E21B 19/00 166/77.1 |
| 2015/0034335 | A1 * | 2/2015 | Brown | E21B 19/10 166/379 |

* cited by examiner

*Primary Examiner* — Taras P Bemko
(74) *Attorney, Agent, or Firm* — Sander R. Gelsing

(57) ABSTRACT

In one aspect the invention provides a support structure for use on a rig floor and for supporting a unit used to manipulate tubular components through a wellhead, the support structure comprises a first section, a second section and a central passage of sufficient diameter to allow passage of the tubular components therethrough. When the first section and the second section are assembled together, said sections together are suitable to support said unit used to manipulate tubular components through a wellhead.

15 Claims, 31 Drawing Sheets

PUSH / PULL SYSTEM AND SUPPORT STRUCTURE FOR SNUBBING UNIT OR THE LIKE ON A RIG FLOOR

CROSS REFERENCE TO RELATED APPLICATION

This application is a regular application of U.S. Provisional Patent Application Ser. No. 61/862,080 filed Aug. 4, 2013 and entitled, "PUSH/PULL SYSTEM AND SUPPORT STRUCTURE FOR SNUBBING UNIT OR THE LIKE ON A RIG FLOOR", the entirety of which is incorporated herein by reference.

FIELD OF THE INVENTION

The invention relates to rigs above a wellhead, such as snubbing units and push/pull units, for manipulating tubing in and out of a well.

BACKGROUND OF THE INVENTION

It is well known to attach a variety of rigs such as hydraulically operated rigs above a wellhead. For example, snubbing units are known in the oil and gas industry for facilitating access to a well which is under pressure including, for example, well operations such as well completions. A snubbing unit includes structure and equipment above a wellhead for manipulating tubular components such as pipe, tubing, and bottom hole assemblies (BHA) in and out of a well while controlling the well under pressure.

Generally, a snubbing unit employs stationary (lower) and traveling (upper) slip assemblies, opposingly oriented, to releasably and controllably shift tubular components into and out of the well through a wellhead despite the possibility of either heavy tubular loads, which urge the tubular components to fall into the well, or the pressure-generated forces on the tubular components, which urge the tubular components out of the well. The snubbing unit is installed above an existing wellhead seal, such as that created by a blow-out preventer (BOP), and incorporates its own seals to seal the tubular components as they are introduced or removed from the wellhead, such as through the use of a stripping head.

Most conventional snubbing units fall into either rig-assisted or self-contained units. Rig-assisted snubbing units are typically snubbing units that are pivotally mounted to a truck and require assistance by an onsite service rig so as to winch them upright, pivoting from the truck, to a snubbing position over the wellhead. Self-contained units are typically transported to site on a truck and lifted into position, over the wellhead, by a separate crane unit. During operations, self-contained snubbing units do not require the assistance from an on-site rig.

When snubbing in low-pressure well environments, such as wells with surface pressures under 12,000 kPa, a compact, rig-assisted snubbing unit is often the ideal choice. A compact snubbing unit can be easily transported to the well site, such as in a 1 ton pickup truck, and is practical and cost effective for single wells and underbalanced drilling. Additionally, a compact snubbing unit reduces or eliminates viewing obstructions often experienced by service rig operators when utilizing traditional (larger) sized snubbing units. One example of a compact snubbing unit is the one marketed under the trade-mark MINI BRUTUS by Team Snubbing Services Inc. of Rocky Mountain House, Alberta, Canada.

Despite the many advantages of a compact snubbing unit, the set-up of such a unit still requires the snubbing unit to be installed above an existing wellhead seal and to incorporates its own seals to seal the tubular components as they are introduced or removed from the wellhead. Typically a compact snubbing unit, such as the MINI BRUTUS™, is installed above a blow-out preventer (BOP) and incorporates an RS-100 stripping head as its seal to seal the tubular components.

Push/pull systems or push/pull units are also known in the art and are used to manipulate tubular components in and out of a well. Push/pull units provide alternatives to, and/or improvements over, conventional snubbing systems. Such push/pull systems are generally mounted at the rig floor (e.g. on the rotary table) and, therefore, allow live well operations to be conducted at the rig floor rather than in the greatly elevated work baskets as is generally the case with conventional snubbing units. One example of a push/pull system is that manufactured by Tesco Corporation of Calgary, Alberta, Canada. However, the prior art push/pull systems manufactured by Tesco Corporation is cumbersome, large and heavy, does not have the compactness that has become associated with compact snubbing units such as the MINI BRUTUS™ and cannot be used to retrofit such compact snubbing units and/or convert such units into a push/pull system.

Applicant's prior-filed applications (U.S. Ser. Nos. 61/148,922 and 12/464,034) and issued Canadian patent no. 2,652,068, address many of these above-noted disadvantages, and as more clearly illustrated in FIGS. 1-18 and the following background description thereof.

Referring to FIGS. 1-18, a PRIOR ART compact snubbing or push/pull unit 12 (or most of the components thereof) is supported on a PRIOR ART load bearing apparatus or support structure 20 having a central passage 20*c* of sufficient diameter to allow passage of tubular components T therethrough, preferably having at least one tensile member mount 21 to facilitate the connection of one or more tensile members 40 between the support structure 20 and a mounting point on a rig or rig floor RF and having a support member or support plate 22. The support plate 22 is adapted to be secured to, or within, the compact snubbing unit 12. The compact snubbing unit 12 comprises stationary (lower) and traveling (upper) slip assemblies 14*s*, 14*t*, traveling plate 15*t* (to support the travelling slip assembly 14*t* and having a central passage 15*tc* of sufficient diameter to allow passage of tubular components T therethrough), bottom or stationary plate 15*s* (to facilitate mounting of the compact snubbing unit 12 to the support structure 20 and having a central passage 15*sc* of sufficient diameter to allow passage of tubular components T therethrough) and a pair of jacking rams 16*a*, 16*b* securely mounted to the stationary plate 15*s* and actuatable in a conventional manner to releasably and controllably shift tubular components T into and out of the well through a wellhead. Preferably, jacking rams 16*a*, 16*b* are hydraulic rams.

Jacking rams 16*a*, 16*b* are securely mounted to the compact snubbing unit 12 in the conventional manner. The stationary plate 15*s* comprises paired ram cut-outs or recesses 15*a*, 15*b*, said ram recesses 15*a*, 15*b* being substantially positioned at 180° across from each other around central passage 15*sc* and at the periphery of the stationary plate 15*s* (see FIG. 12). Further, the jacking rams 16*a*, 16*b* each comprise an annular groove 16*ag*, 16*bg* of such diameter and dimensions to allow secure placement of the jacking rams 16*a*, 16*b* within the ram recesses 15*a*, 15*b* (see FIG. 7) and the compact snubbing unit 12 further comprises ram keepers or ram retainers 17*a*, 17*b*. As such, jacking rams 16*a*, 16*b* are securely mounted to the compact snubbing unit 12 in the conventional manner, i.e. by placing the annular grooves 16*ag*, 16*bg* of jacking rams 16*a*, 16*b* within the respective ram recesses 15*a*, 15*b* and then bolting or otherwise fasten the ram retainers 17*a*, 17*b* so as to maintain secure placement of the jacking rams 16*a*, 16*b* on the stationary plate 15*s* (see FIGS. 6-8, 10 and 11).

The support structure 20 further comprises ram openings or ram passages 22*a*, 22*b*, in the support plate 22, each ram passage 22*a*, 22*b* being coaxially aligned with ram recesses 15*a*, 15*b* of the stationary plate 15*s* and each ram passage 22*a*, 22*b* being of sufficient diameter to allow passage of the jacking rams 16*a*, 16*b* therethrough (see FIGS. 1, 5-6, 9 and 10). Preferably, ram passages 22*a*, 22*b*, while allowing of passage of the jacking rams 16*a*, 16*b* therethrough, are positioned and are of such dimensions so as to have the support structure 20 still provide some contact surface area SA or support for the ram retainers 17*a*, 17*b* and are not so large so as to also allow passage of said ram retainers 17*a*, 17*b* therethrough when the compact snubbing unit 12 is mounted to the support structure 20 and is subject to pushing or pulling forces from the tubular components T. As more clearly shown in FIGS. 1-6, the support structure 20 comprises plurality of rig engaging members or legs 24 distributed around and connected to the support plate 22.

The support plate 22 is secured to the compact snubbing unit 12 by bolting or fastening to the stationary plate 15*s* in a conventional manner. The stationary slip assembly 14*s* is unfastened from the stationary plate 15*s*, stationary plate 15*s* and ram retainers 17*a*, 17*b* are fastened directly underneath the support plate 22 and stationary slip assembly 14*s* is placed and fastened directly above the support plate 22 thereby sandwiching the support plate 22 between the stationary slip assembly 14 and the stationary plate 15*s* (see FIGS. 6 and 10). As such, support structure 20 is mounted within the compact snubbing unit 12. In another variation of this PRIOR ART support structure (not shown), the stationary plate 15*s* is fastened directly on top of and against the top surface of the support plate 22 and then the support structure 20 can more easily accommodate significant downward forces, such as those which might be created when heavy tubular loads urge the tubular components T to fall into the well.

During operations, the support structure 20 is positioned on a rig floor RF above a wellhead (not shown) extending from the ground and including standard wellhead components and wellhead seals. Loads and downward forces from the compact snubbing unit 12 and/or tubular components T are generally distributed into the rig floor RF through the support structure 20 and legs 24. Where upward forces (e.g. where the well pressure-generated forces on the tubular components T urge the tubular components T out of the well) are expected to be incurred, one or more tensile members 40 can be utilized to further secure the support structure 20 to the rig or rig floor RF via the tensile member mounts 21. Typically, tensile members 40 are chains and fasten the support structure 20 to the rig floor RF in a conventional manner.

FIG. 13 illustrates an alternate PRIOR ART variation of a support unit 20, which is similar to that of FIGS. 1-12, but wherein the compact snubbing unit 12 does not comprise a stationary plate, wherein the ram passages 22*a*, 22*b* are adapted to act as, and have similar dimension to, the ram recesses 15*a*, 15*b* of the embodiment in FIGS. 1-12, and wherein the jacking rams 16*a*, 16*b* are securably mounted directly to the support plate 22 of the support structure 20 (in a similar or identical manner as they are mounted to the stationary plate 15*s* of the embodiment of FIGS. 1-12) through use of ram retainers 17*a*, 17*b*.

FIGS. 14-18 illustrate the configuration of another PRIOR ART variation of a support unit 20 which is similar to that of FIGS. 1-12, but which further comprising a worker platform 50 to support a worker W. The worker platform 50 places a worker W in a safe and efficient position to conduct well operations and to handle the tubular components T.

However, prior to installing a compact snubbing unit or push/pull unit and/or in combination with a support structure 20, tubular components may already be positioned fully through a rig floor, or extend up from the wellhead partway up through the rig floor. For example, when tubular components are stuck in a wellbore, then a snubbing or push/pull unit 12 may be helpful to provide additional force to move and loosen such stuck tubular components T. In such a case, the tubular components T may need to be disconnected and removed; and/or the compact snubbing unit or the push/pull unit 12 may have to be lifted into position, over top of such tubular component T, by a separate crane unit or the like. This complicates installation of the compact snubbing or push/pull unit 12, may require cranes or the like and adds to the installation time and cost of the compact snubbing or push/pull unit 12 onto the rig floor. What is needed is a compact snubbing or push/pull unit and/or support structure 20 that does not suffer from the above-noted disadvantages and which can be easily installed onto a rig floor RF when tubular components T are already present and extend up through the rig floor RF.

SUMMARY OF THE INVENTION

In an embodiment of the invention, a support structure for use on a rig floor and for supporting a unit used to manipulate tubular components through a wellhead is provided. The support structure comprises a first section, a second section and a central passage of sufficient diameter to allow passage of the tubular components therethrough. When the first section and the second section are assembled together, said sections together are suitable to support said unit used to manipulate tubular components through a wellhead.

In a preferred embodiment the first section of the support structure further comprises a first central passage recess which has an opening of sufficient dimensions to allow a tubular component to, at least, be partially placed into the first central passage recess, the second section of the support structure further comprises a second central passage recess which has an opening of sufficient dimensions to allow a tubular component to, at least, be partially placed into the second central passage recess. When the first and second sections of the support unit are placed adjacent to each other, the first central passage recess and the second central passage recess together create the central passage.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1:
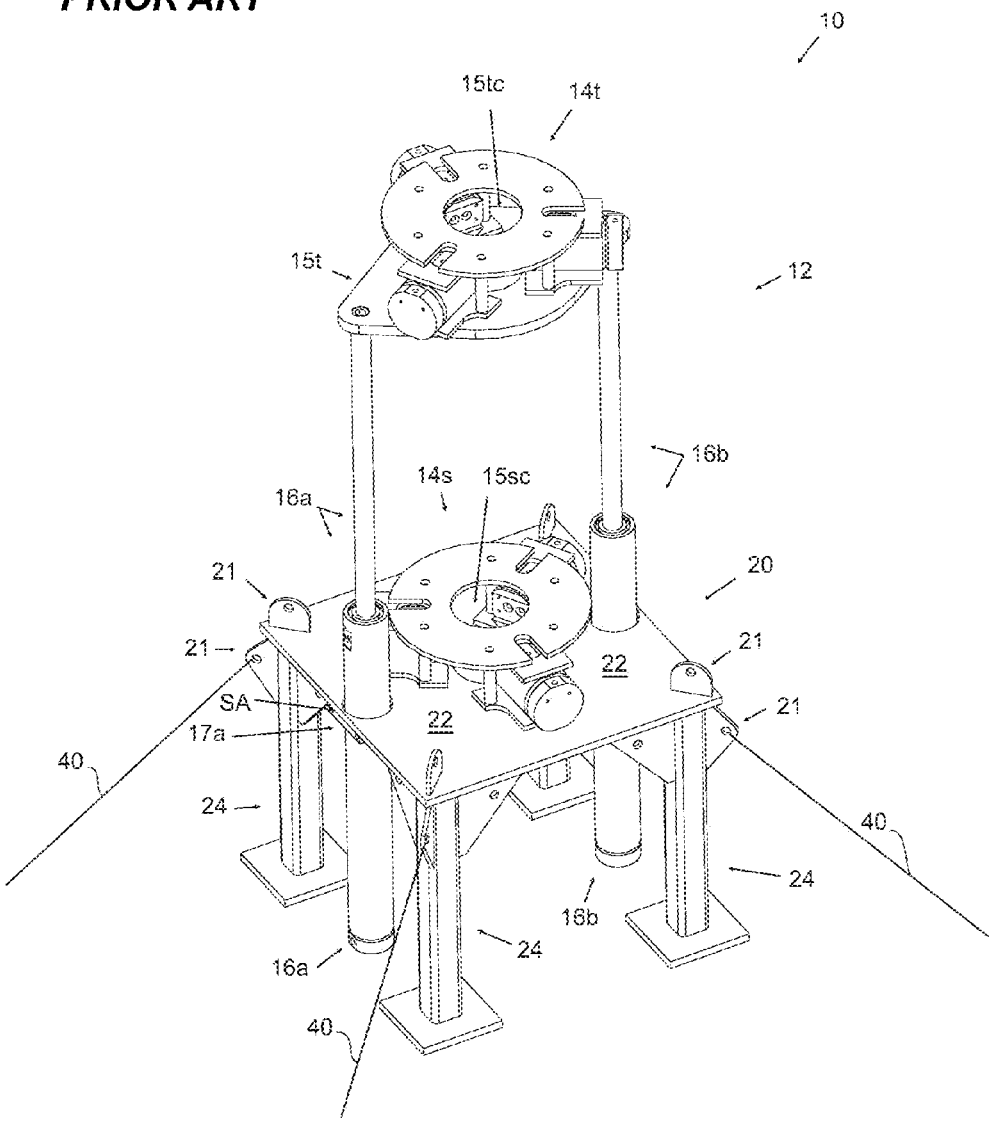
Fig. 1 PRIOR ART
FIGS. 1-18 are various views of PRIOR ART support structures supporting PRIOR ART snubbing and/or push/pull units.
Figure 2:
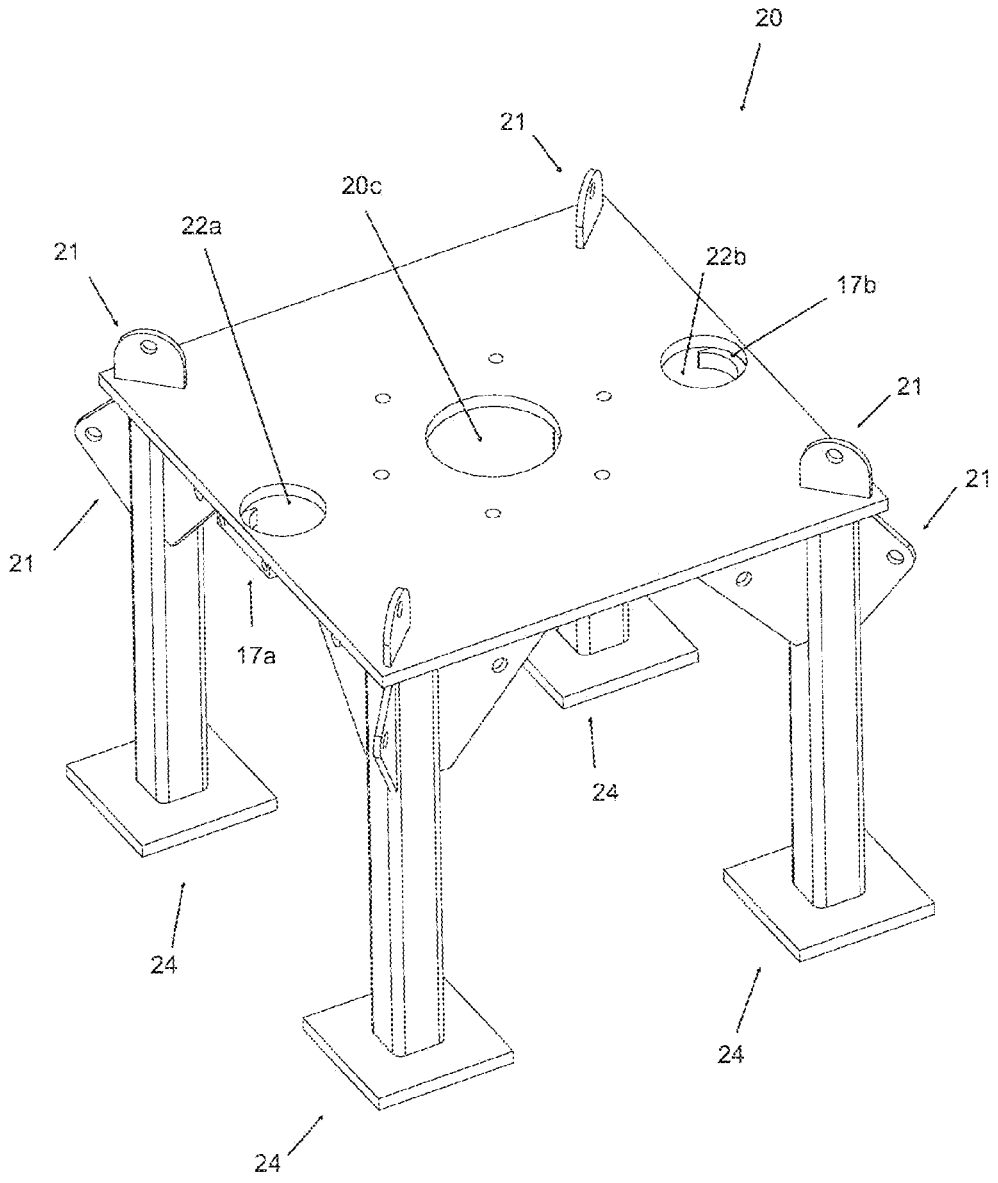
Fig. 2 PRIOR ART
Figure 3:
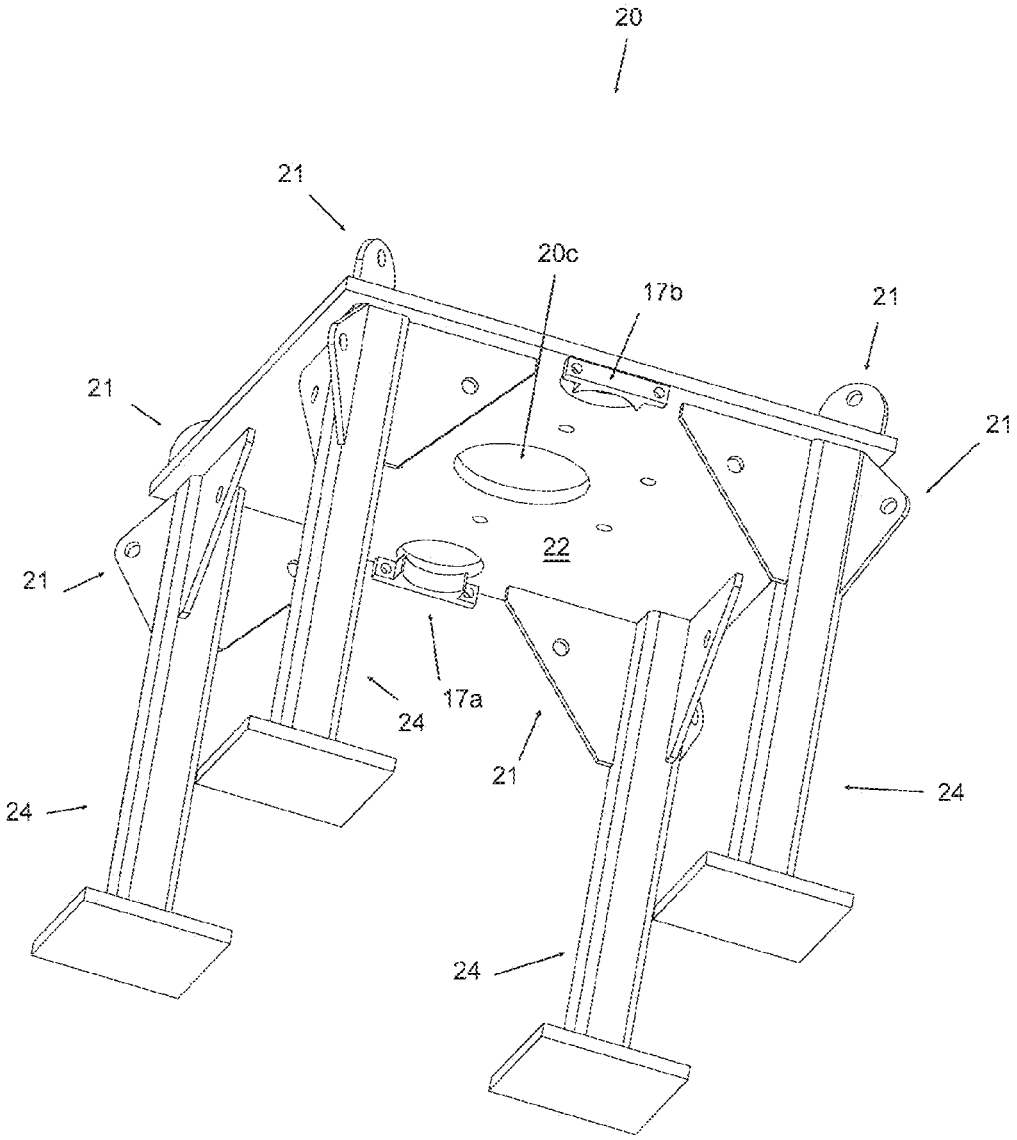
Fig. 3 PRIOR ART
Figure 4:
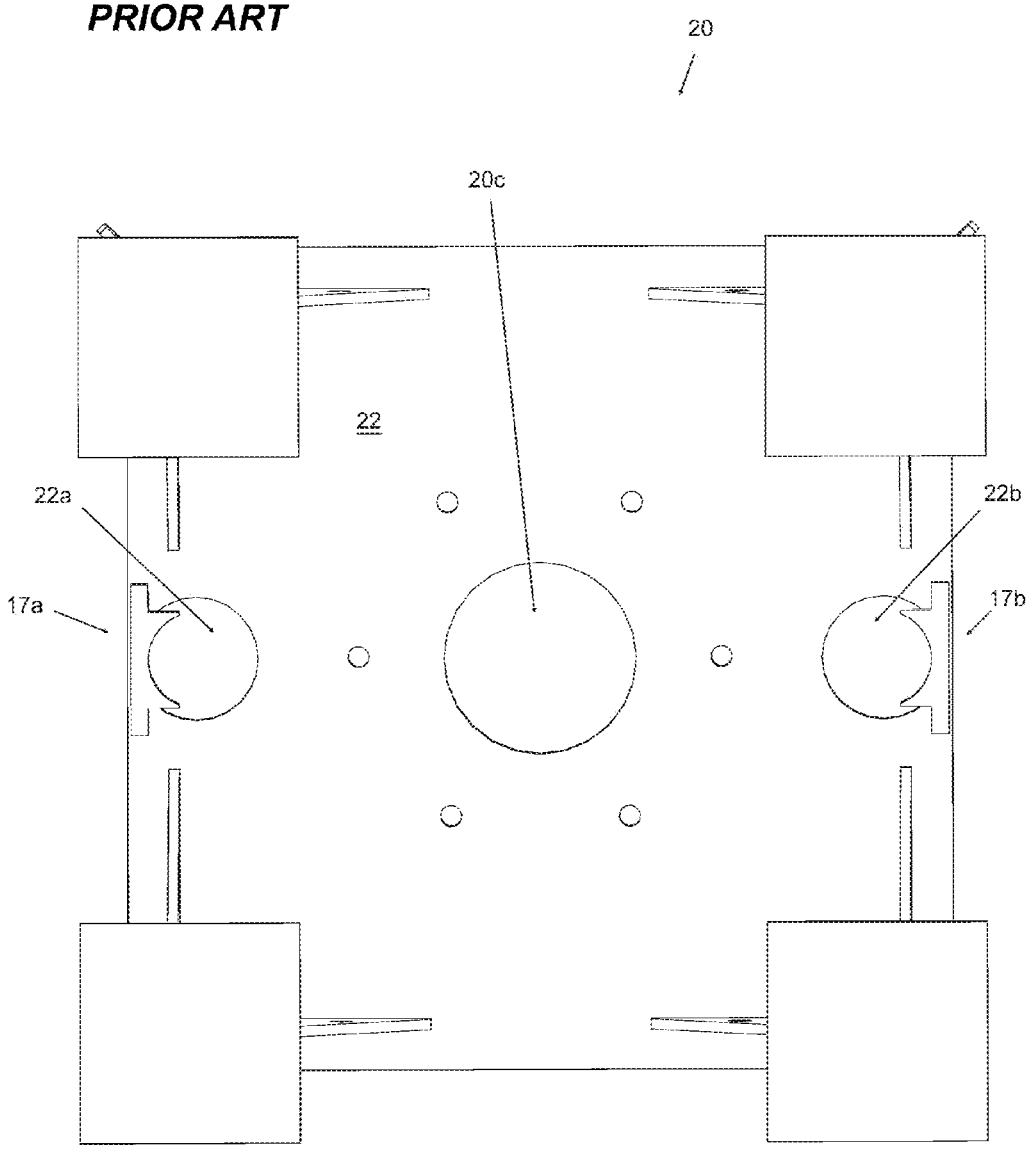
Fig. 4 PRIOR ART
Figure 5:
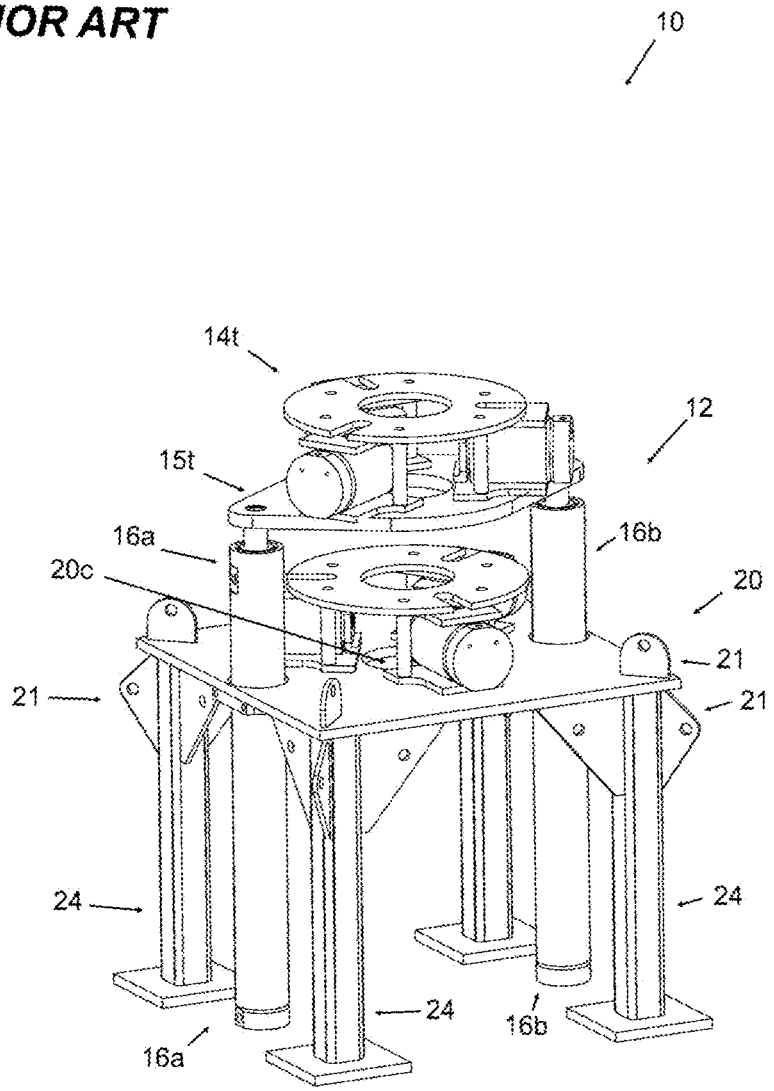
Fig. 5 PRIOR ART
Figure 6:
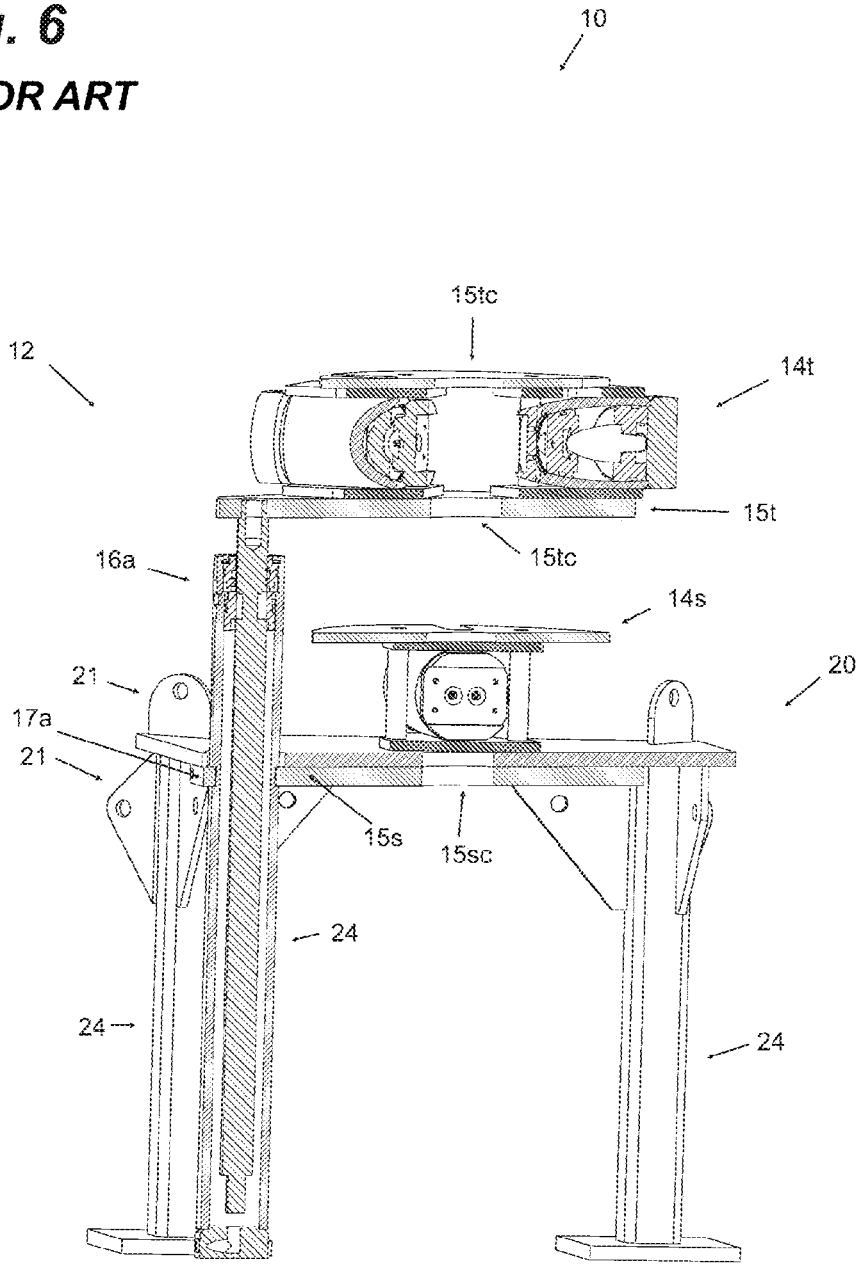
Fig. 6 PRIOR ART
Figure 7:
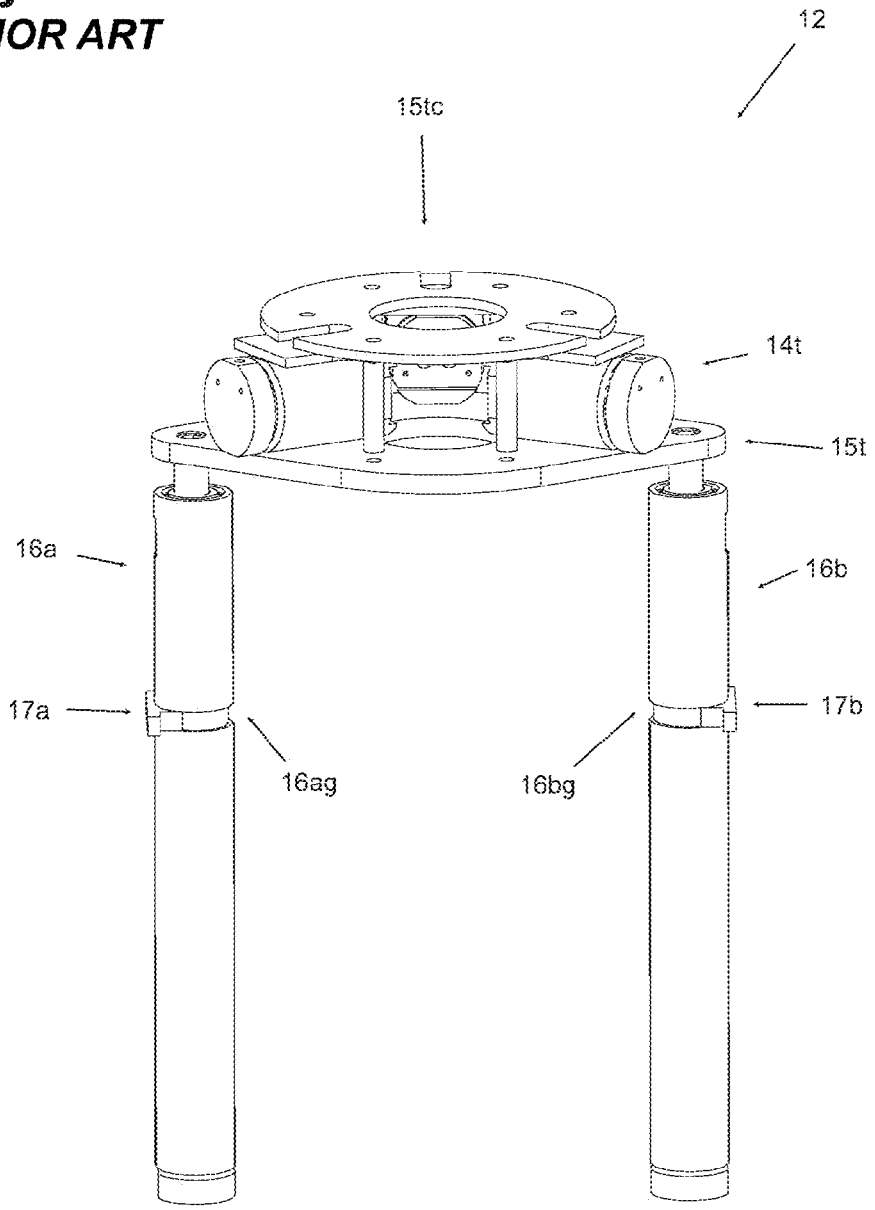
Fig. 7 PRIOR ART
Figure 8:
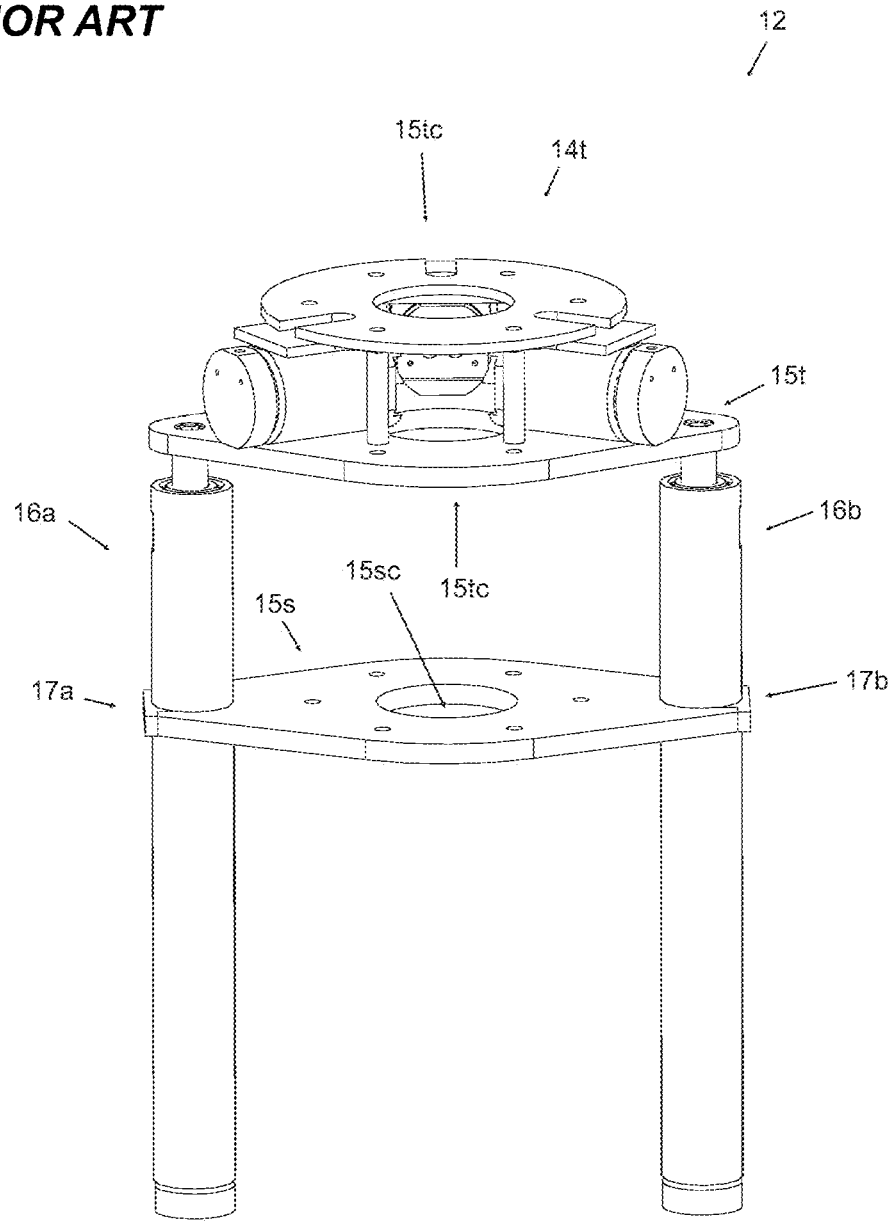
Fig. 8 PRIOR ART
Figure 9:
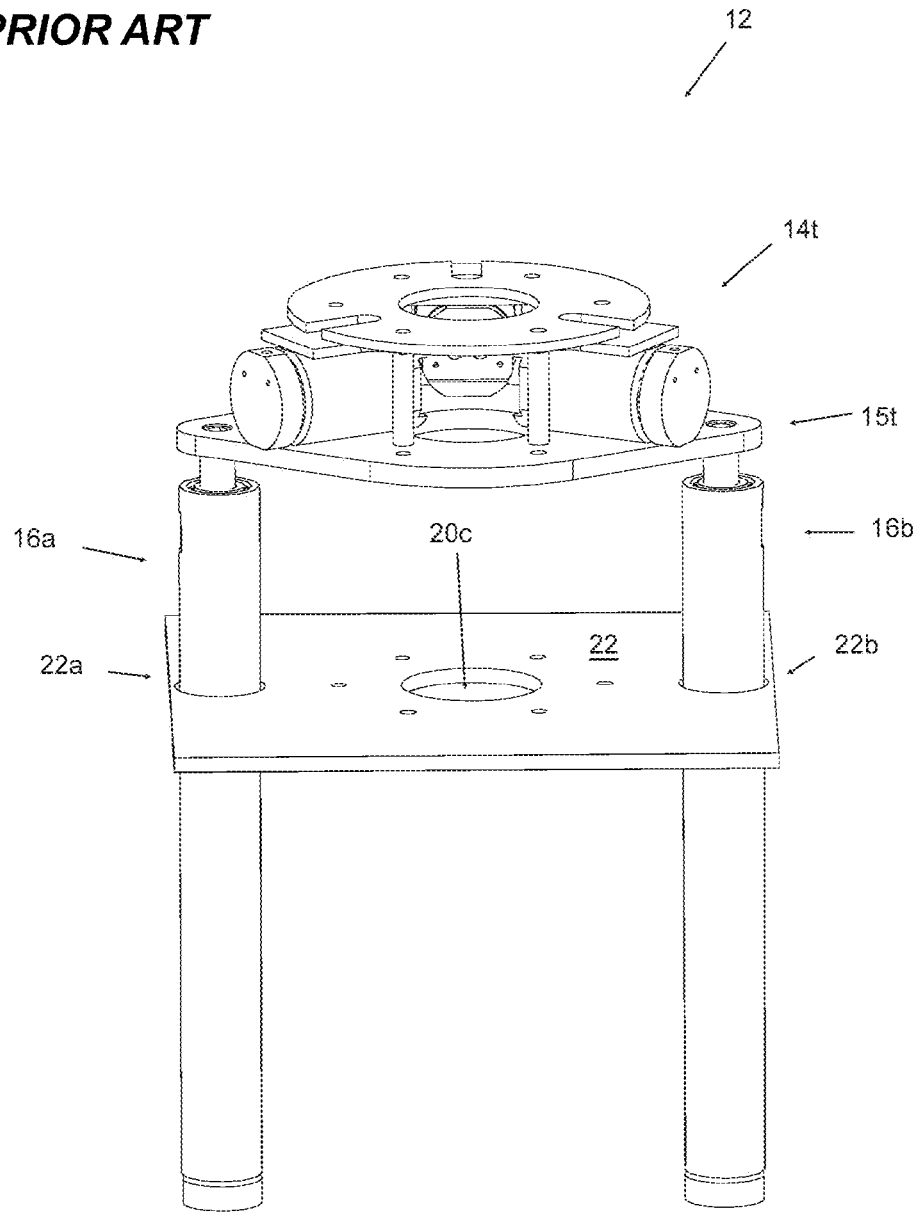
Fig. 9 PRIOR ART
Figure 10:
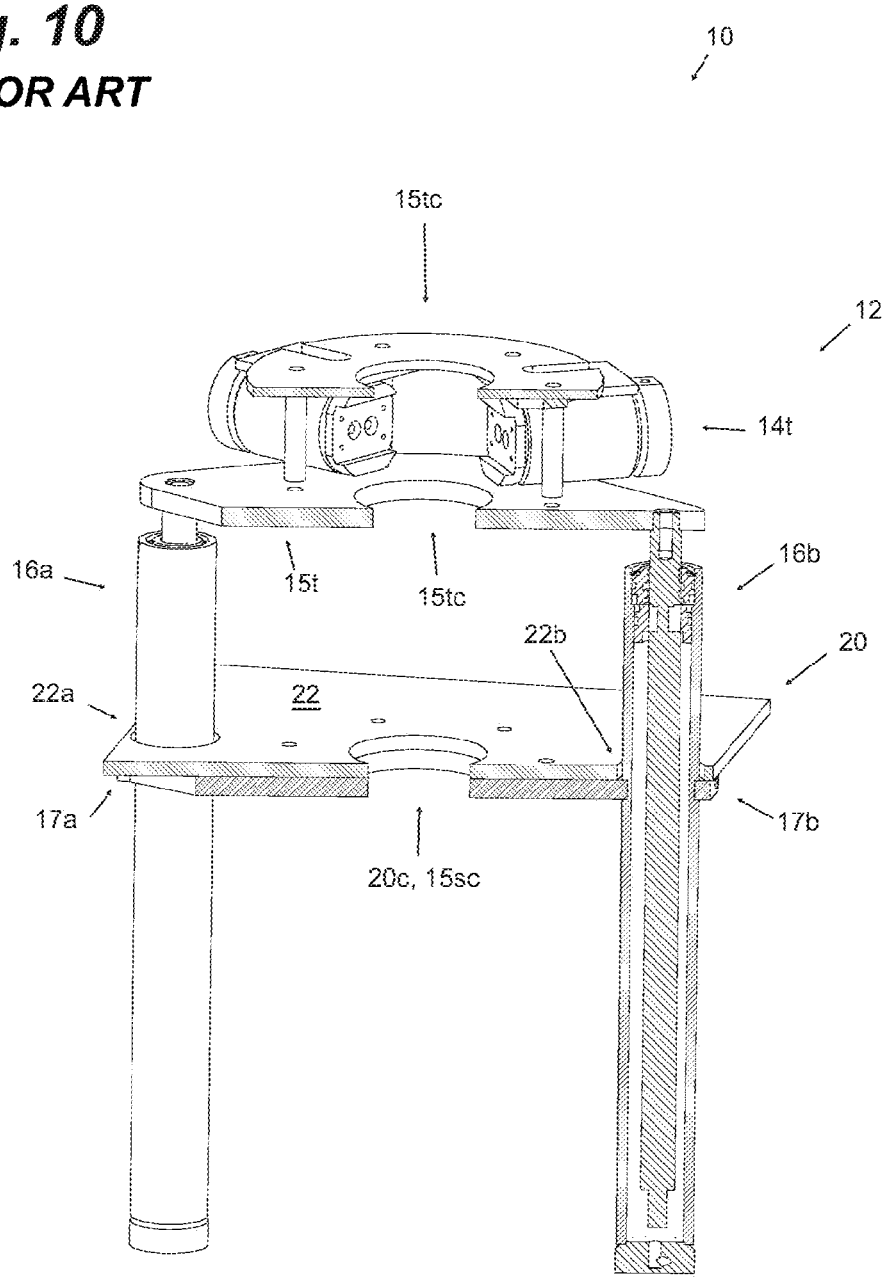
Fig. 10 PRIOR ART
Figure 11:
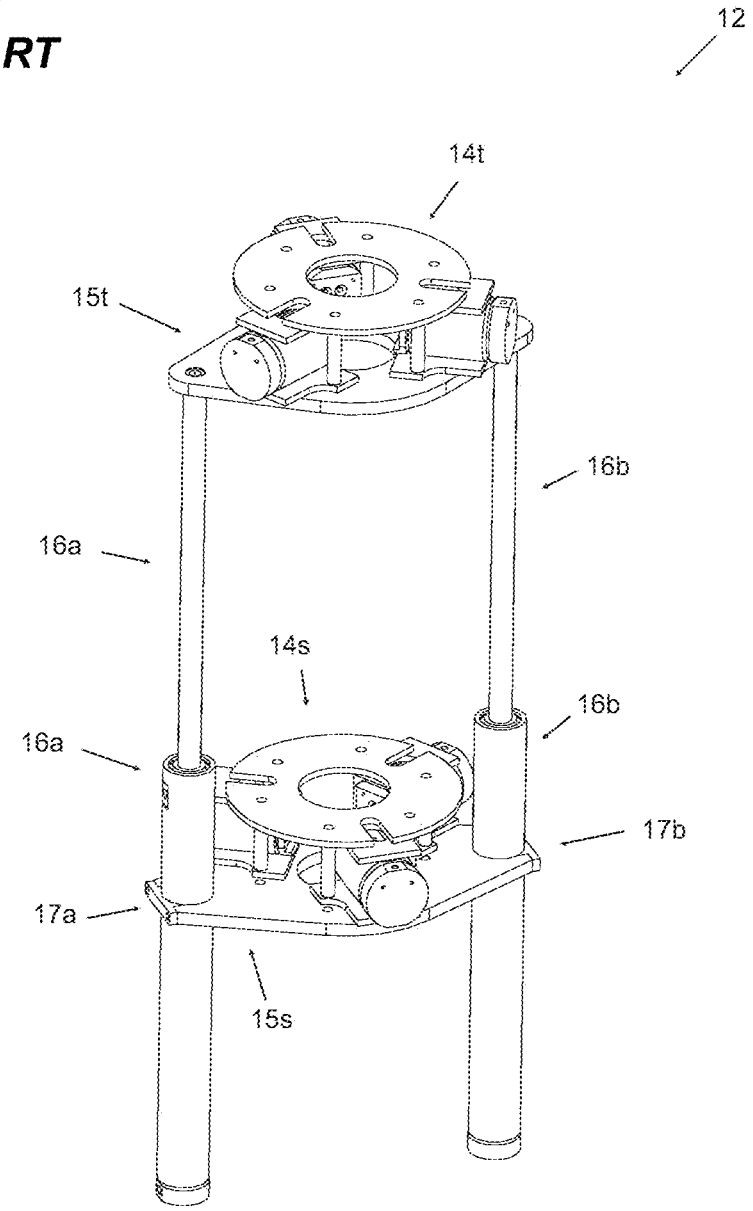
Fig. 11 PRIOR ART
Figure 12:
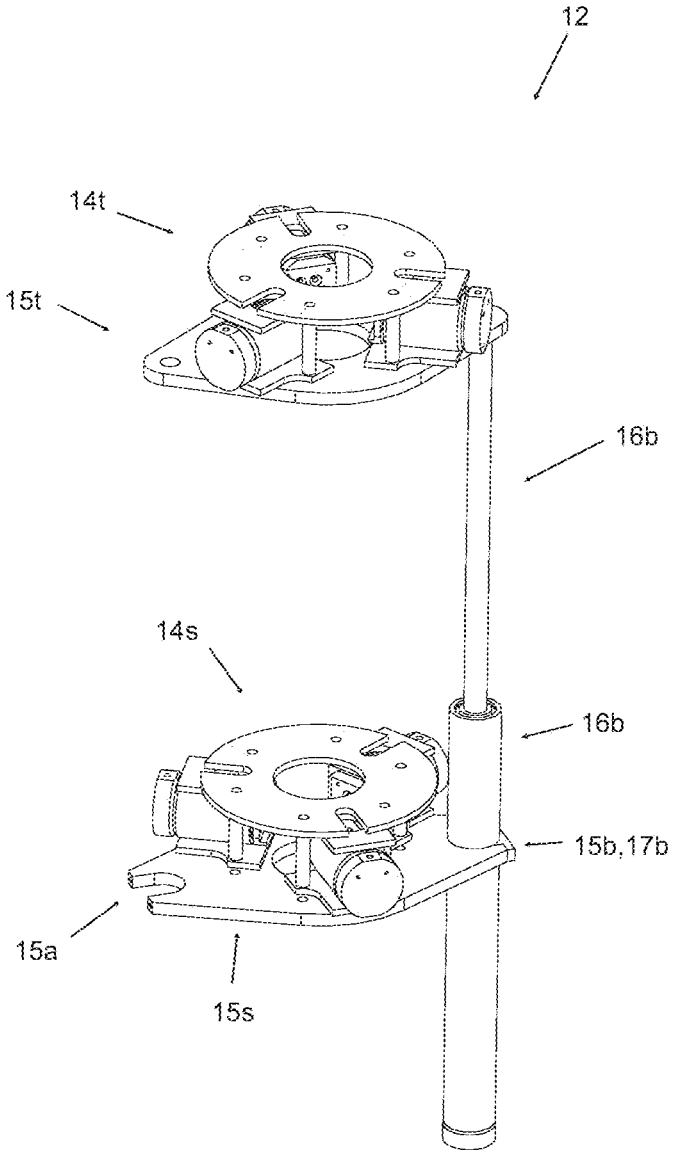
Fig. 12 PRIOR ART
Figure 13:
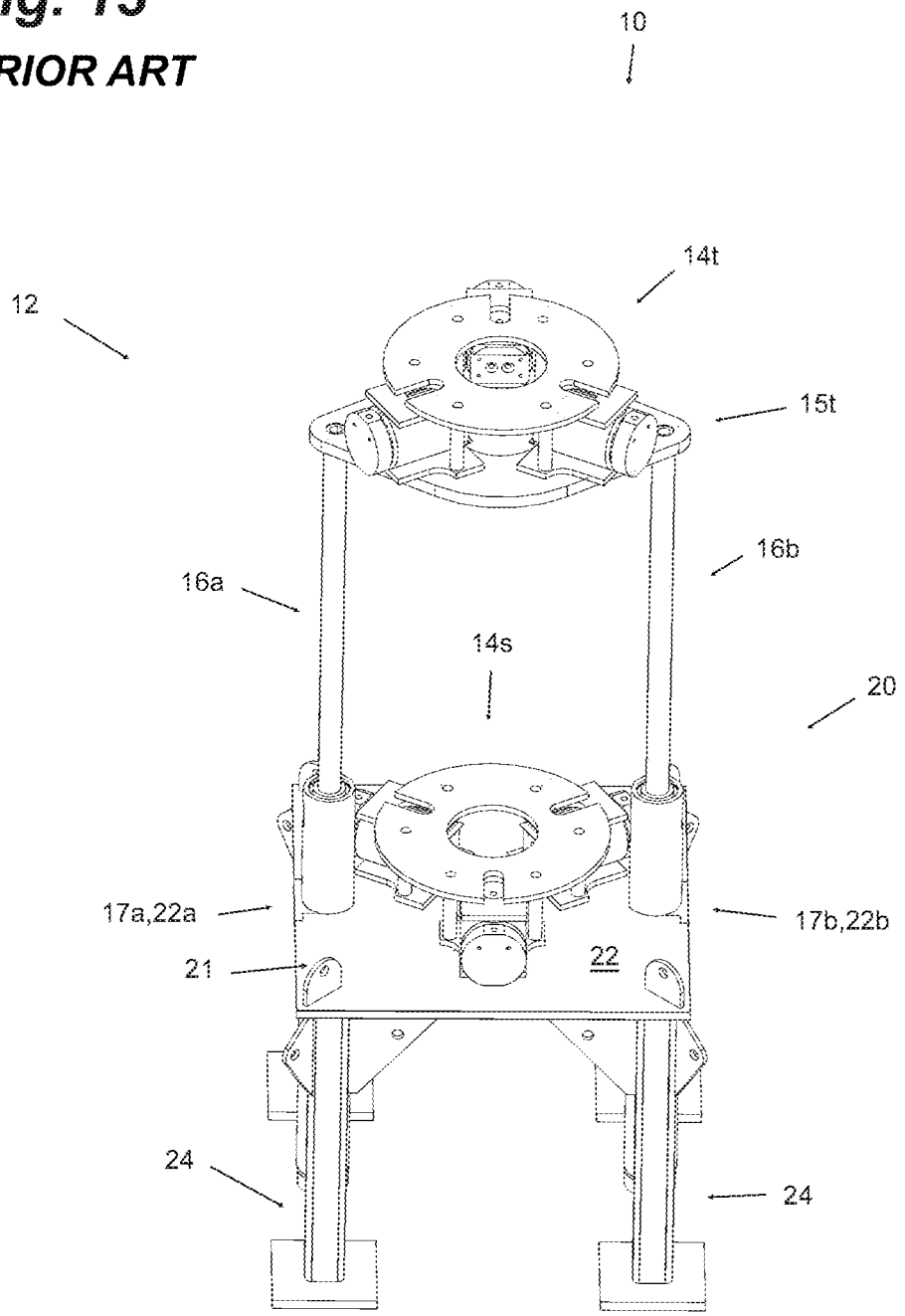
Fig. 13 PRIOR ART
Figure 14:
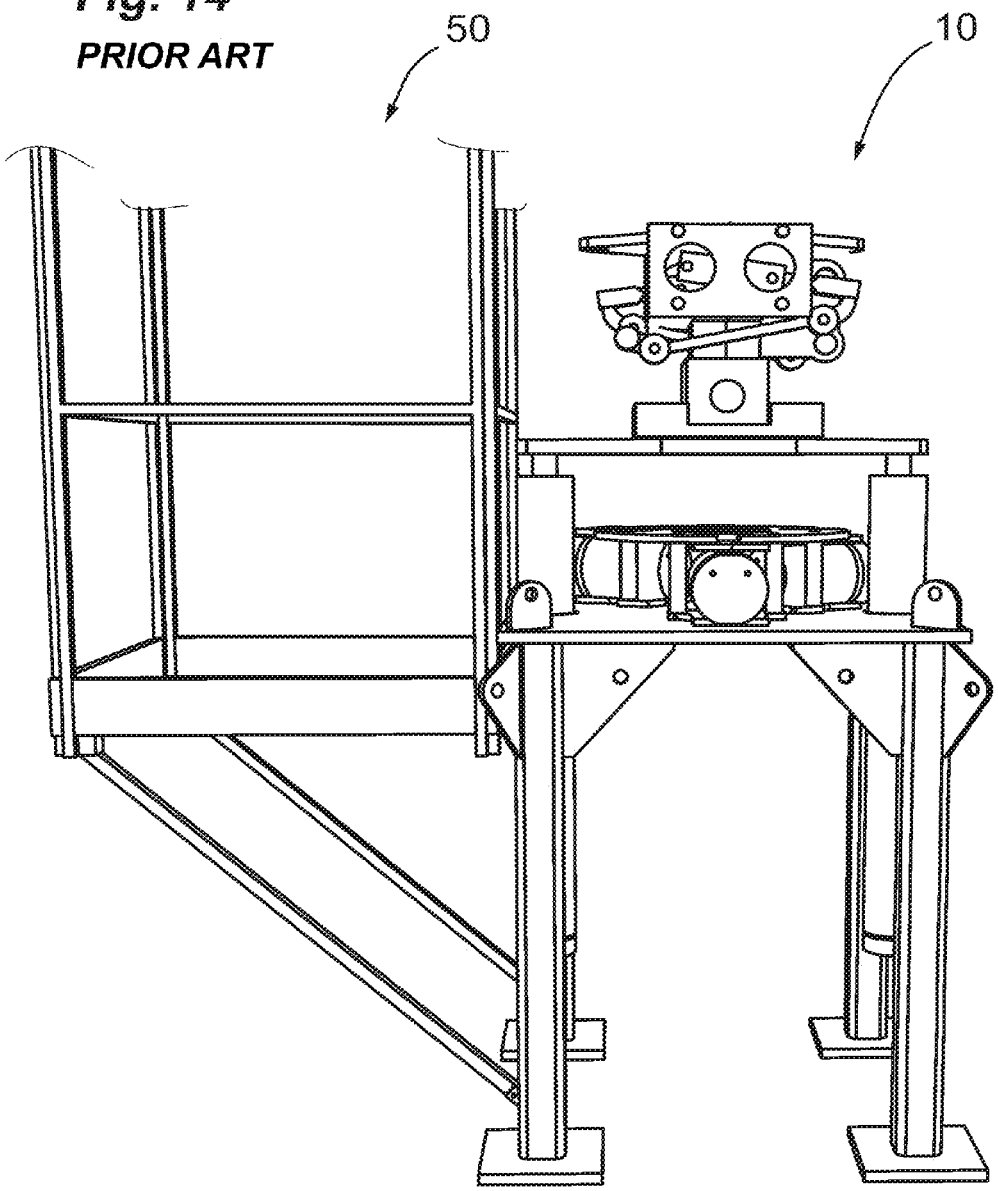
Fig. 14 PRIOR ART
Figure 15:
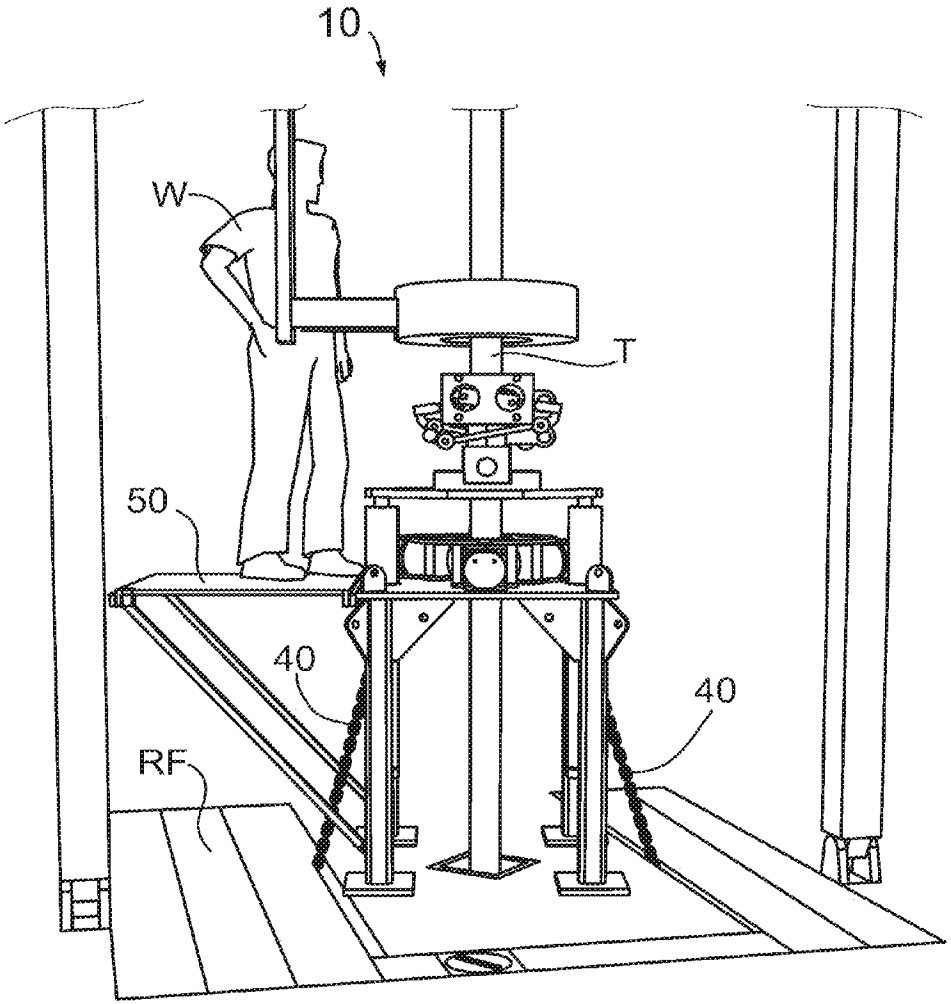
Fig. 15 PRIOR ART
Figure 16:
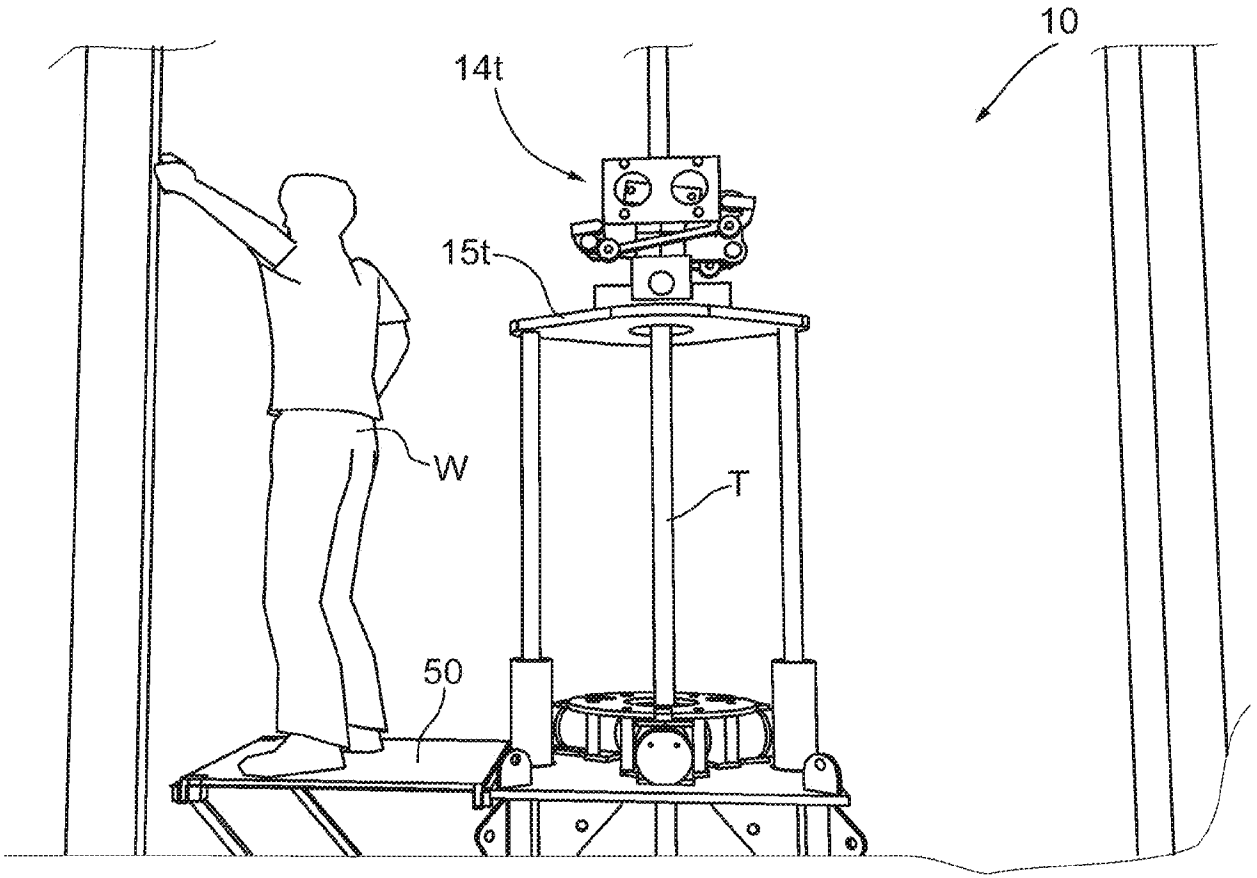
Fig. 16 PRIOR ART
Figure 17:
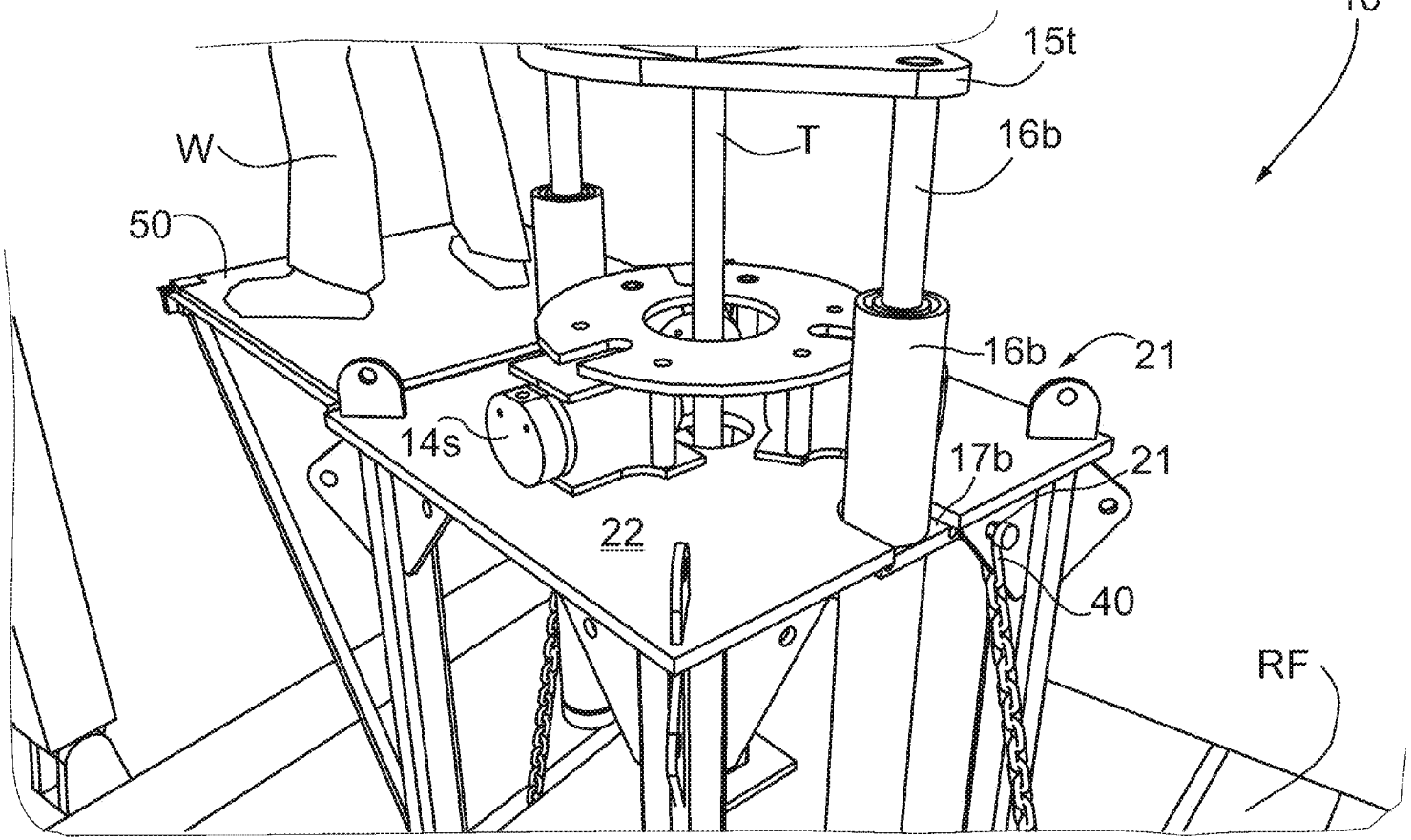
Fig. 17 PRIOR ART
Figure 18:
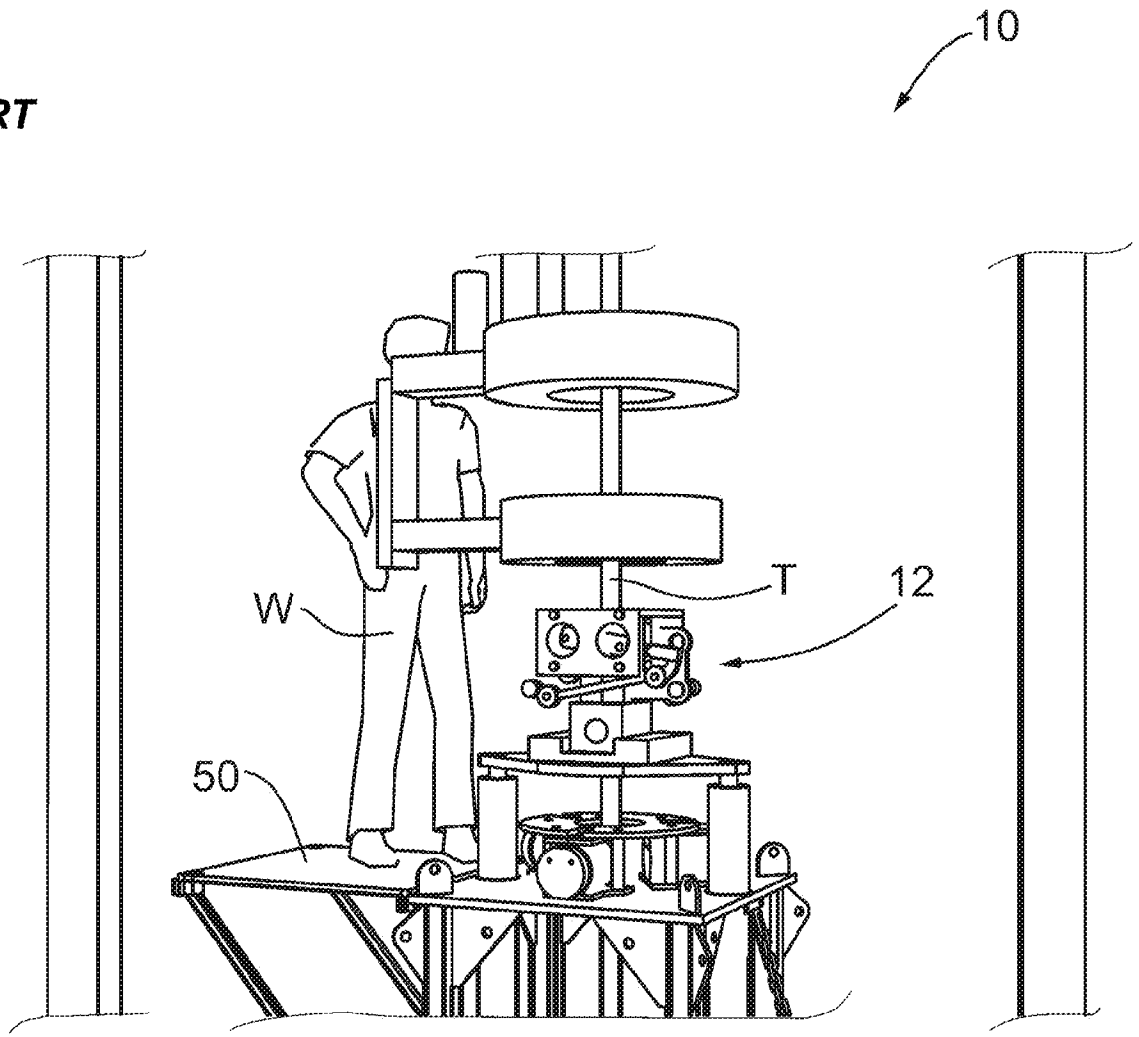
Fig. 18 PRIOR ART
Figure 19:
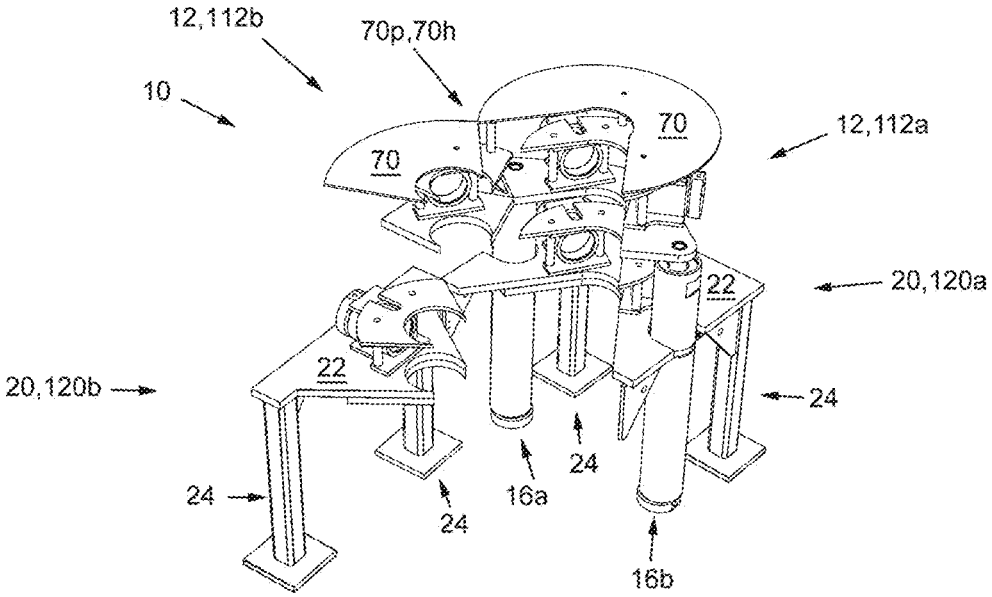
FIGS. 19-28 are various perspective views of a first embodiment of the invention.
Figure 20:
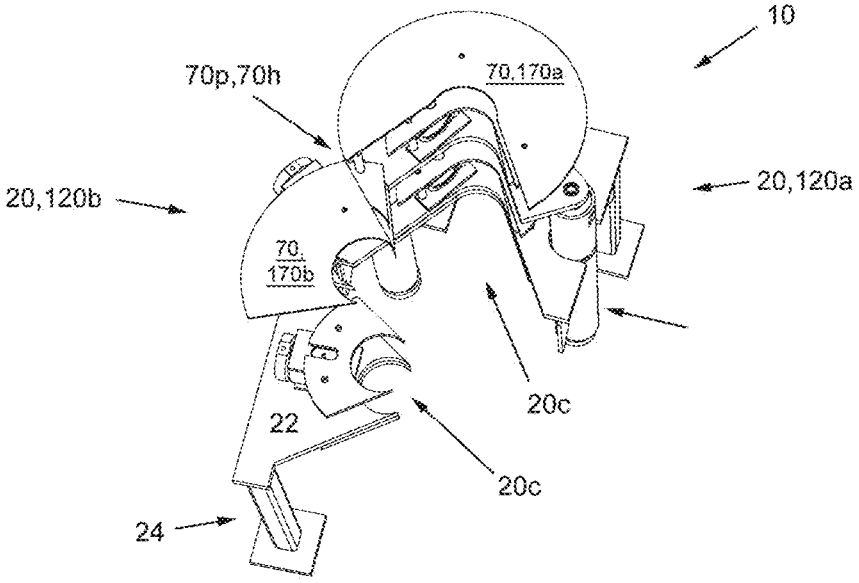
Figure 21:
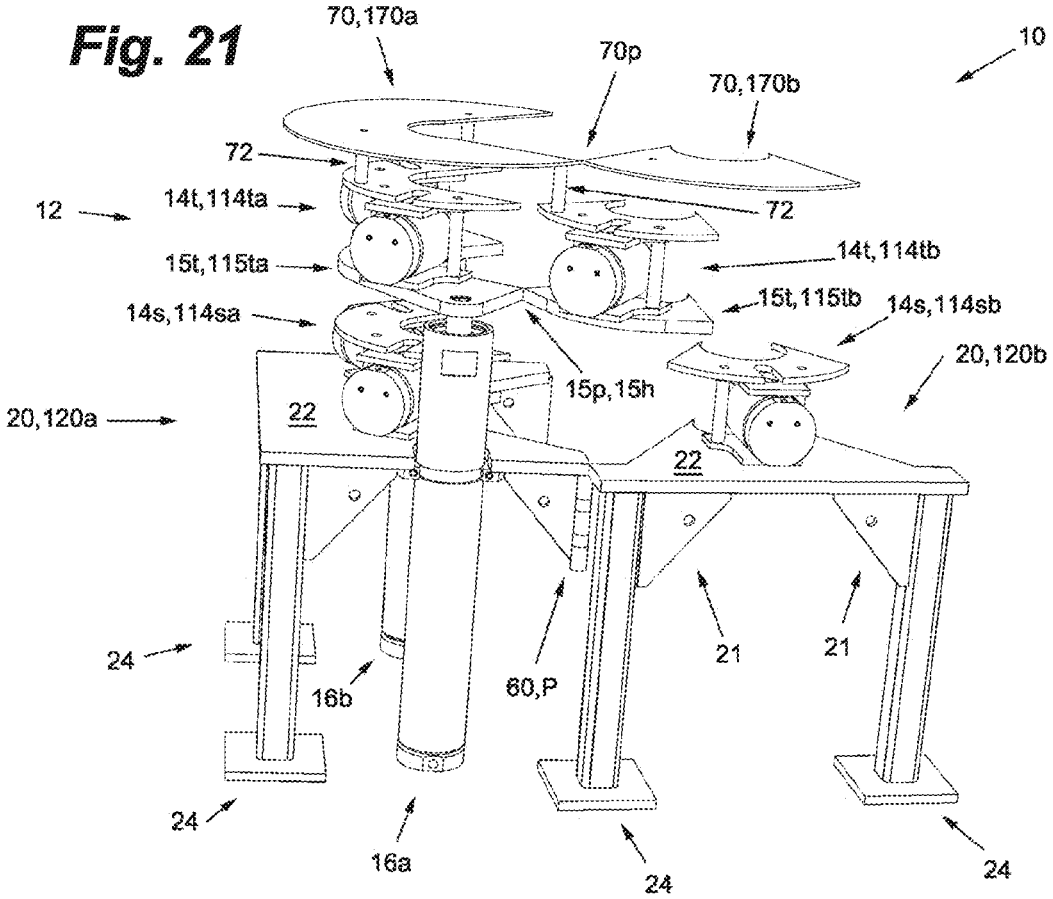
Figure 22:
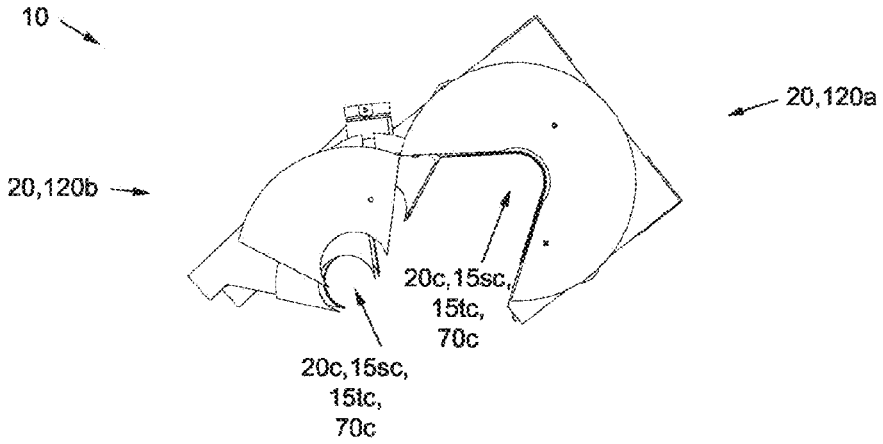
Figure 23:
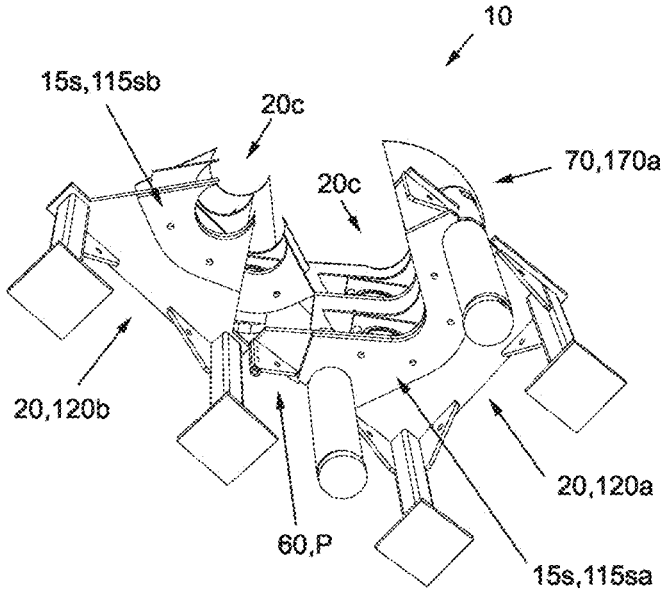
Figure 24:
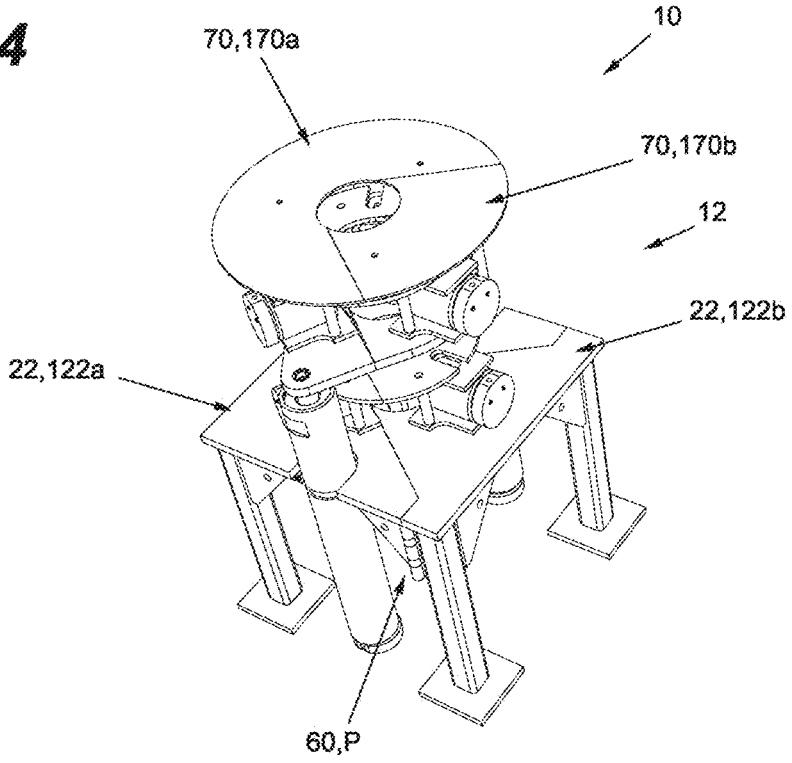
Figure 25:
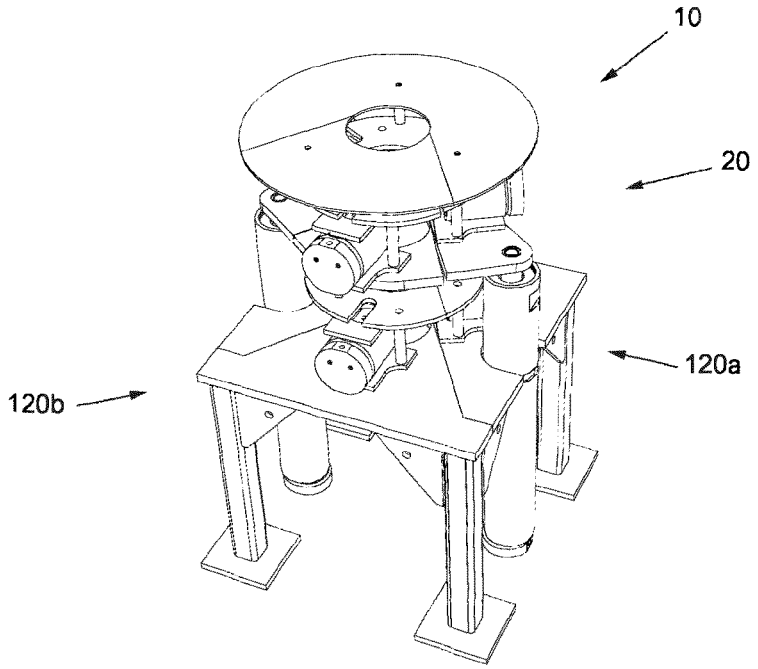
Figure 26:
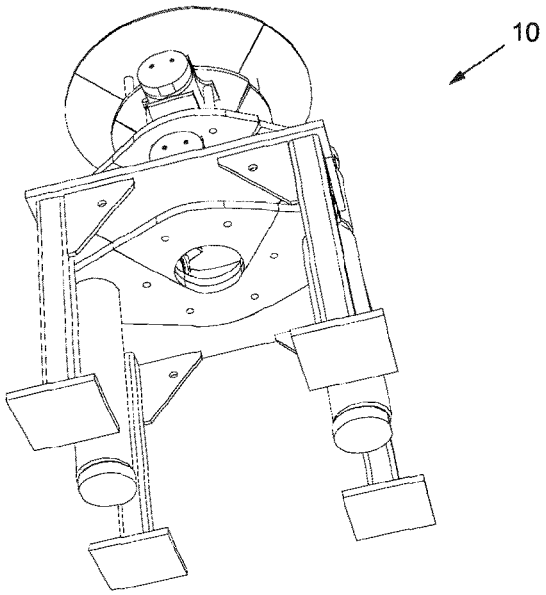
Figure 27:
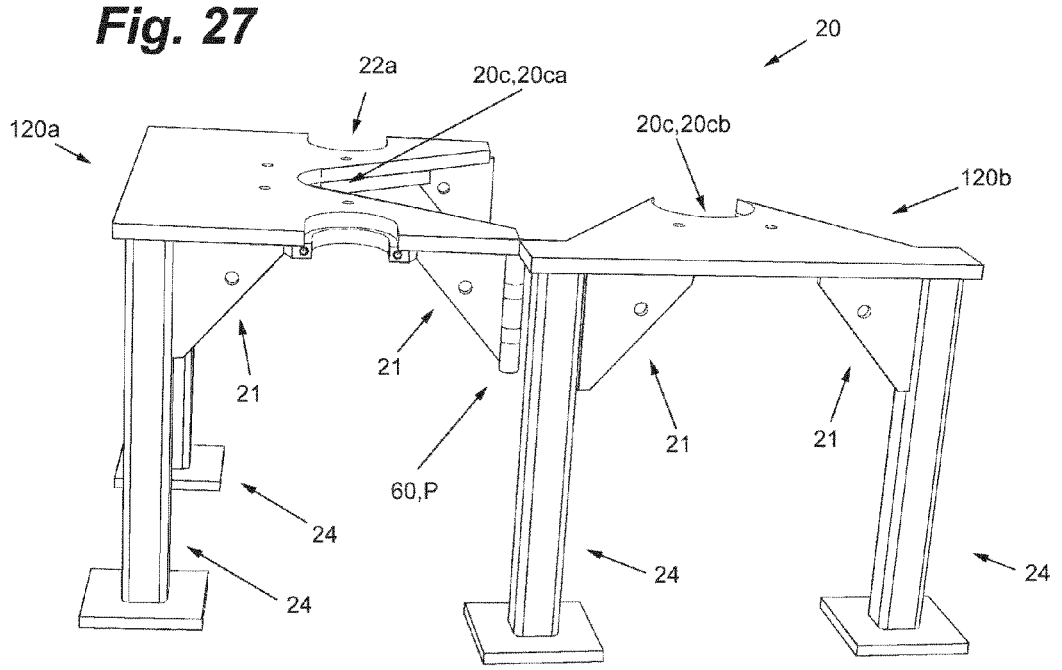
Figure 28:
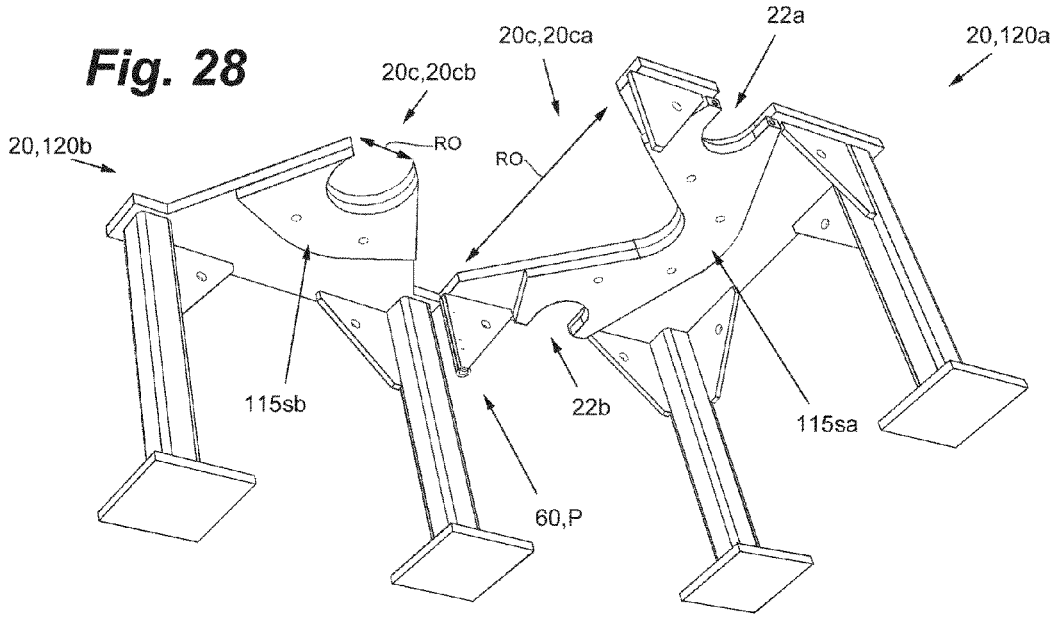
Figure 29:
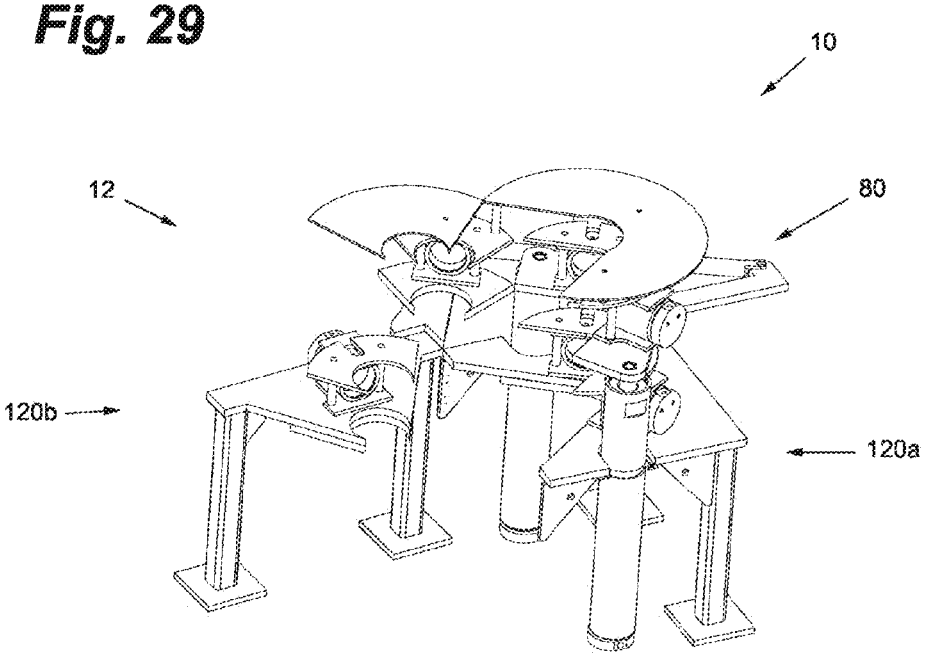
FIGS. 29-40 are various perspective views of a second embodiment of the invention.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

Figure 30:
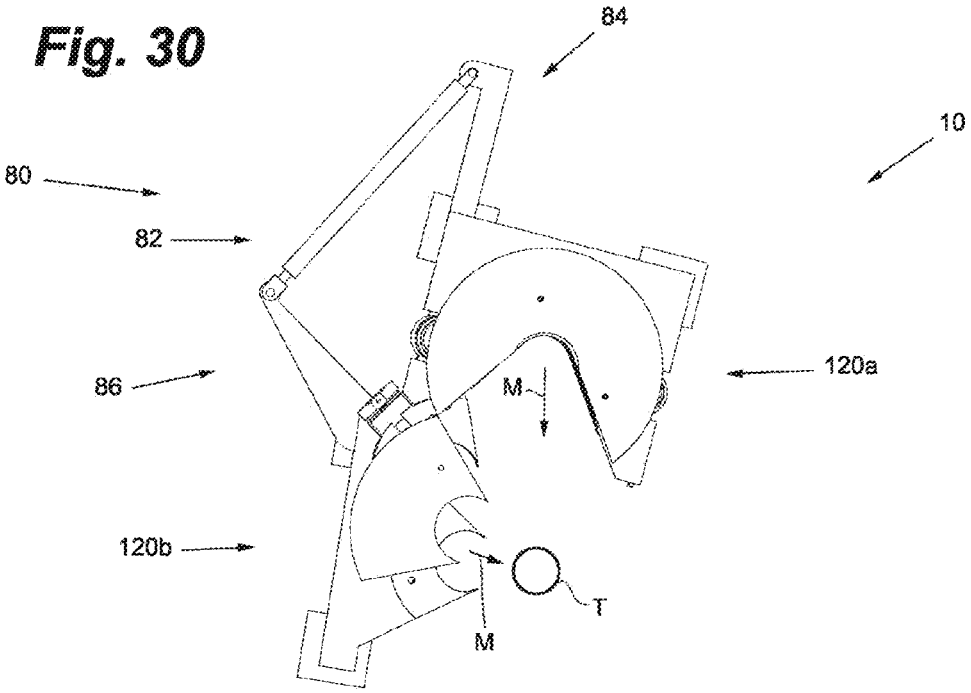
Figure 31:
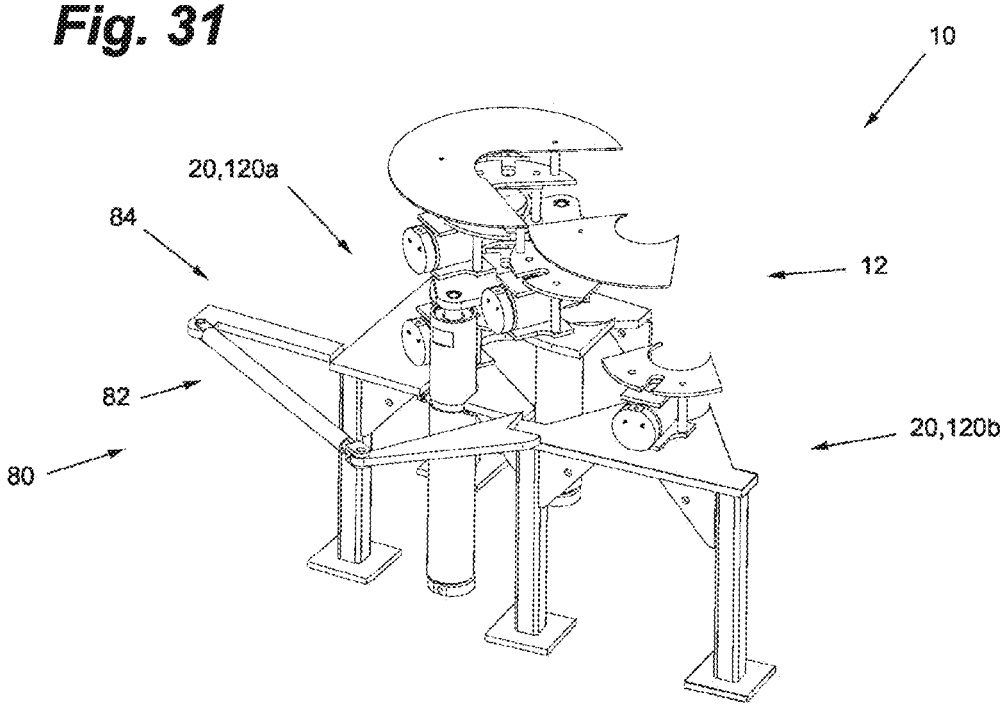
Figure 32:
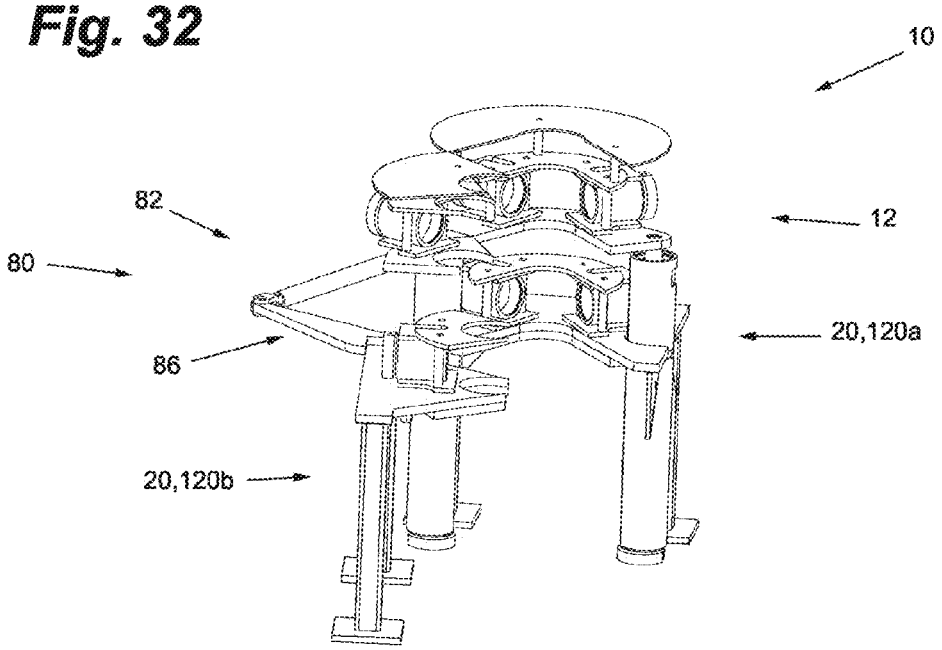
Figure 33:
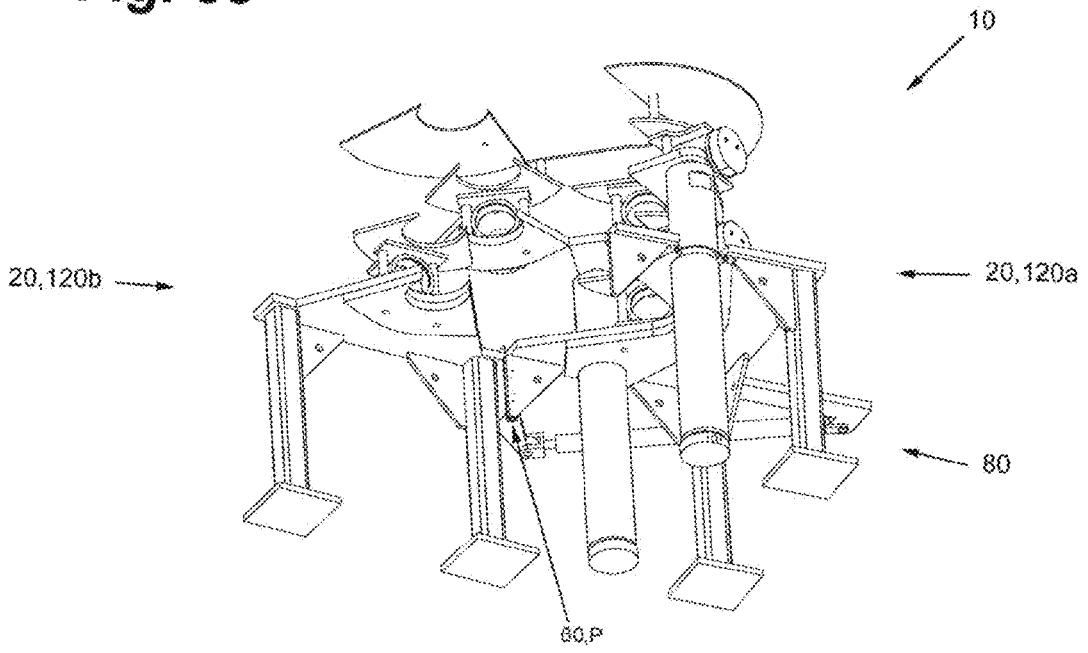
Figure 34:
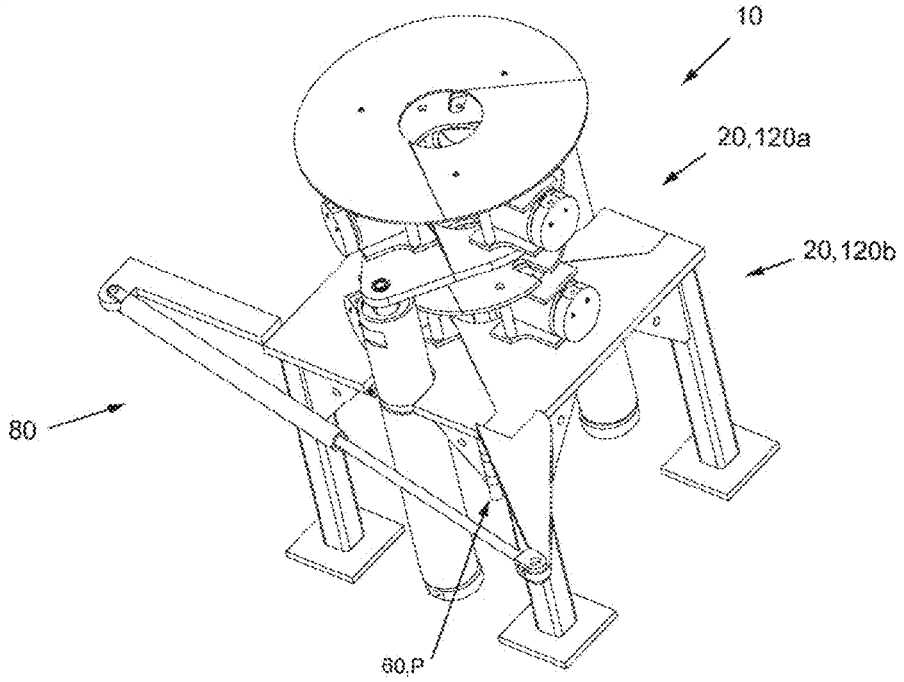
Figure 35:
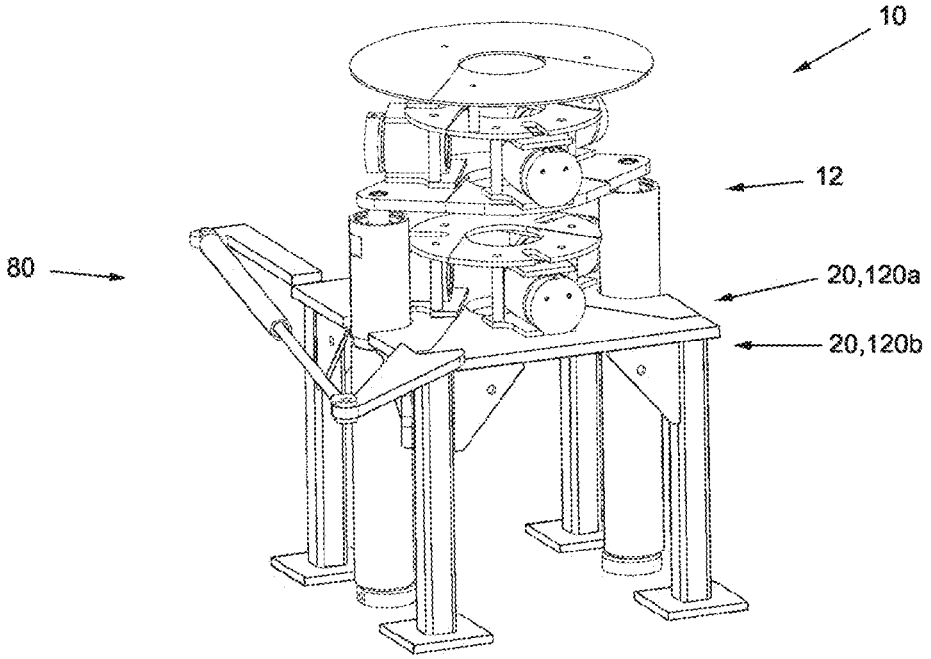
Figure 36:
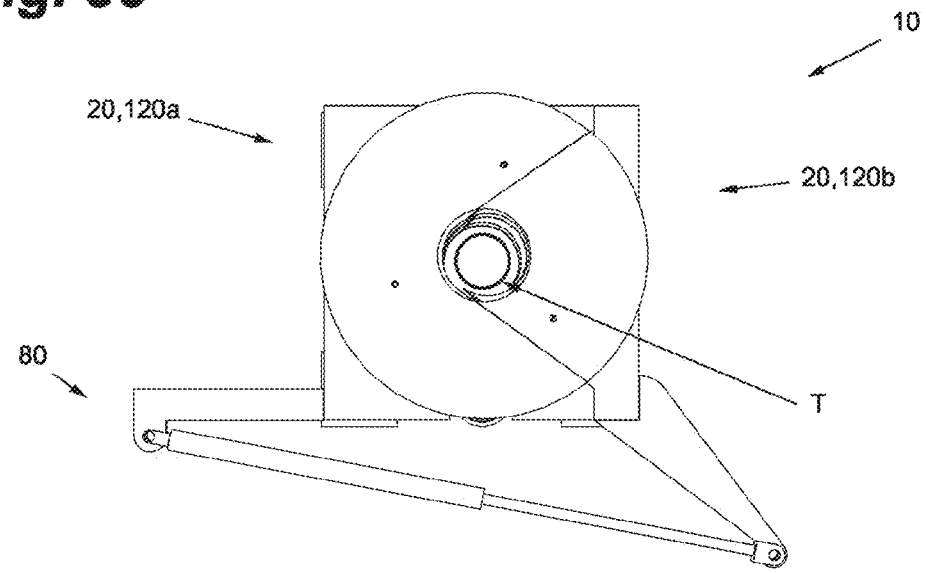
Figure 37:
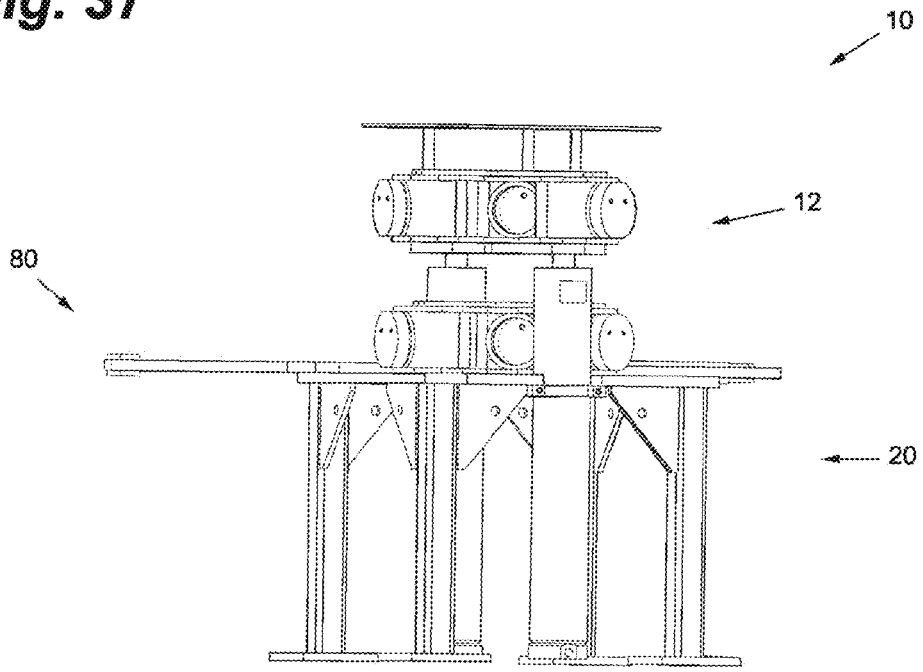
Figure 38:
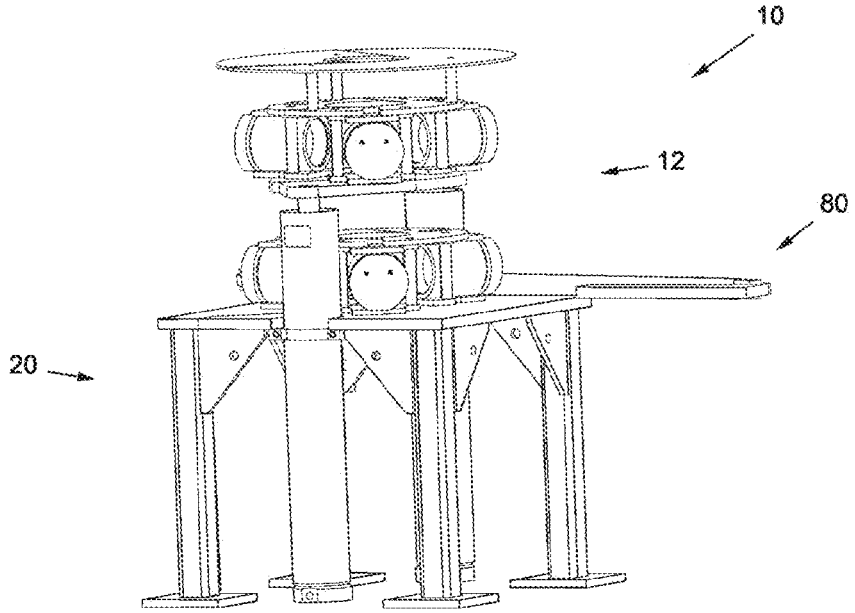
Figure 39:
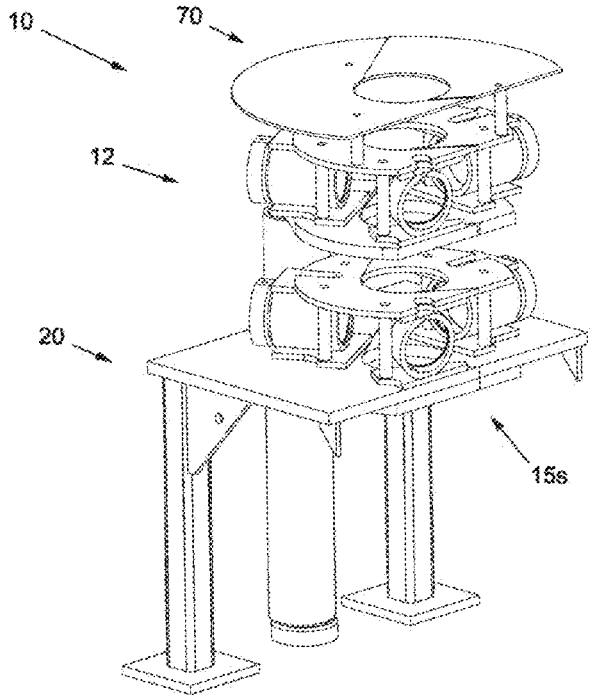
Figure 40:
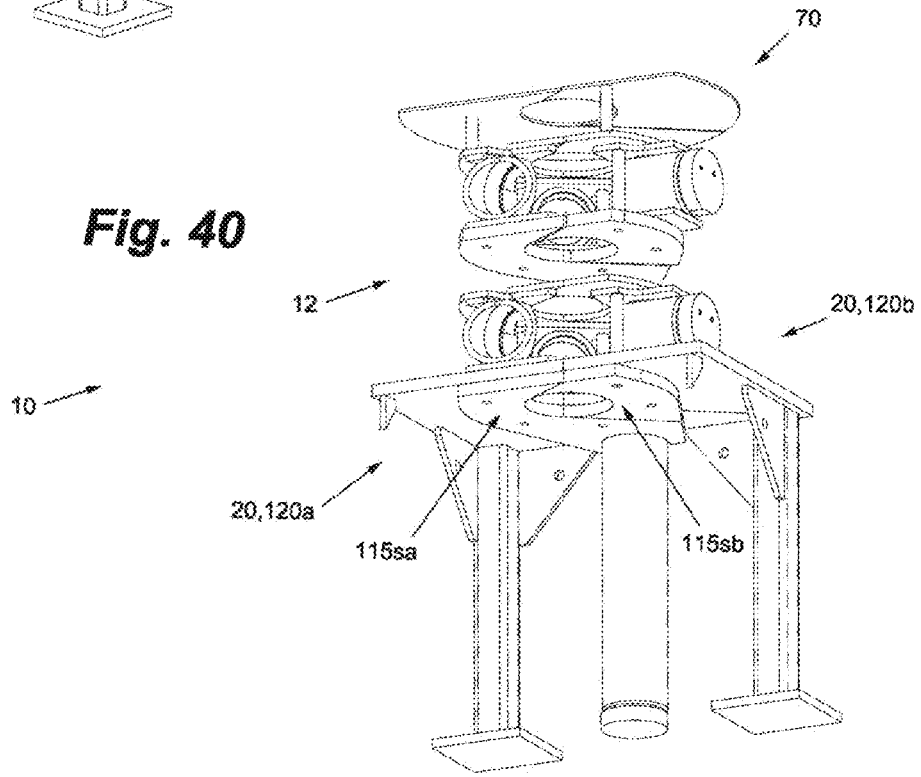

FIGS. 19-43 illustrate the configuration of three embodiments of the present invention 10 which are somewhat similar to the PRIOR ART apparatus and devices of FIGS. 1-18, but wherein the invention 10 is now in two parts to facilitate easy placement of the invention 10 around any tubular components T which may already be positioned fully through a rig floor RF, or which extend up from the wellhead partway up through the rig floor RF (e.g. see FIG. 30). In these three embodiments, the compact snubbing or push/pull unit 12 (or most of the components thereof) now comprise a first section 112*a* and a second section 112*b* which, when assembled or placed together, provide the functionality of a complete compact snubbing unit 12. Likewise, the support structure 20 comprises a first section 120*a* and a second section 120*b* (with the support plate 22 also being divided into a first support plate section 122*a* and a second support plate section 122*b*) which, when assembled or placed together, provide the functionality of a complete support structure 20.

Preferably, first section 120*a* of the support structure 20 supports the first section 112*a* of the compact snubbing unit 12, along with a portion of the second section 112*b*. More preferably, second section 120*b* of the support structure 20 supports the remaining portion of the second section 112*b* of the compact snubbing unit 12; e.g. see FIG. 19. In the three embodiments of FIGS. 19-42, the first section 120*a* of the support unit 120*a* also comprises the ram passages 22*a*, 22*b*, which allow passage of the jacking rams 16*a*, 16*b* therethrough. However, in other embodiments (not shown), ram passages may be on the second section or one ram passage may be on each section. Additionally, in these three embodiments, first section 120*a* and second section 120*b* of the support structure 20 preferably further comprise central passage recesses 20*ca*, 20*cb* which: (i) each have an opening or entry RO of sufficient dimension to allow a tubular component T to, at least, be partially placed into the recess and (ii) when the first and second sections 120*a*, 120*b* of the support unit 20 are placed together or adjacent to each other, create the central passage 20*c* of sufficient diameter to allow passage of tubular components T therethrough; see FIGS. 28, 30 and 36. Preferably, central passage 20*c* has a diameter in the range of at least 7 to 9 inches, to allow the support unit 20 to handle the majority of tubular components T typically found in the oil and gas industry. More preferably, each opening or entry RO of central passage recesses 20*ca*, 20*cb* is also at least 7 to 9 inches wide to accept placement of a tubular component T therethrough.

Preferably, in the three embodiments of FIGS. 19-43, the first section 112*a* of the compact snubbing unit 12 comprises a first section of the travelling plate 115*ta*, a first section of the stationary plate 115*sa*, a first portion 114*sa* of the stationary (lower) slip assembly 14*s* which is associated with the first section of the stationary plate 115*sa*, and a first portion 114*ta* of the traveling (upper) slip assembly 14*t* which is associated with the first section of the traveling plate 115*ta*. Preferably, both the jacking rams 16*a*, 16*b* are operably associated with the first section 112*a* of the snubbing unit 12. However, in other embodiments (not shown) the jacking rams 16*a*, 16*b* may be associated with the section 112*b* of the compact snubbing unit 12; or one jacking ram is associated with each of the first and second sections 112*a*, 112*b*. More preferably, the first and second sections 114*sa*, 114*sb* of the stationary slip assembly 14*s* are each, respectively, mounted to the first and second sections 120*a*, 120*b* of the support structure 20; preferably on the first and second sections 122*a*, 122*b* of the support plate 22, respectively.

Further, in the three embodiments of FIGS. 19-43, the second section 112*b* of the compact snubbing unit 12 comprises a second section of the travelling plate 115*tb*, a second section of the stationary plate 115*sb*, a second portion 114*sb* of the stationary (lower) slip assembly 14*s* which is associated with the second section of the stationary plate 115*sb*, and a second portion 114*tb* of the traveling (upper) slip assembly 14*t* which is associated with the second section of the traveling plate 115*tb*. Preferably, the first and second sections 114*ta*, 114*tb* of the traveling slip assembly 14*t* are pivotally connected, such as at a pivot point 15*p* via a hinge 15*h* (see FIGS. 21 and 43).

Preferably, a guard plate 70 having a first section 170*a* and a second section 170*b* is provided, with first section 170*a* thereof mounted to the top of the first section of the traveling slip 114*ta* and with the second section 170*b* thereof positionable over the top of the second section of the traveling slip 114*tb*; preferably via support members 72. Guard plate 70 further comprises a central passage 70*c* of sufficient diameter to allow passage of tubular components T therethrough. First and second sections 170*a*, 170*b* of the guard plate 70 are preferably hinged via hinge 70*h* at pivot point 70*p*. Advantageously, hinged guard plate 70 and support members 72 provides additional support (and hinging functionality) for the first and second sections 114*ta*, 114*tb* of the traveling slip assembly 14*t* which are pivotally connected, at a pivot point 15*p* (see FIG. 21).

Preferably, although not necessary, first and second sections 120*a*, 120*b* of the support structure 20 are connected together via a hinge 60 at pivot point P, to allow the first and second sections 120*a*, 120*b* to pivot with respect to each other around a substantially vertical pivot axis. Advantageously, hinge 60 allows each of first and second sections 120*a*, 120*b* to still substantially support each other (and, hence, the entire support structure 20) in an upright manner on the rig floor RF with only two legs 24 on each of said second sections 120*a*, 120*b*. In embodiments of the support structure 20 wherein first and second sections 120*a*, 120*b* are provided without a hinge (not shown), additional legs 24 may be provide on each section 120*a*, 120*b* (to stabilize each section), or additional operators may need to be provided to maintain separated sections 120*a*, 120*b* upright until they are fastened securely together around a tubular component T.

More advantageously, the support structure 20 (and any snubbing unit or push/pull unit thereon) can be moved or shuffled along the rig floor RF and, if any tubular components T are positioned through a rig floor or partially extend up from the wellhead through the rig floor, the first and second sections 120*a*, 120*b* can be pivoted to open up the central passage 20*c* sufficiently to allow the support structure 20 to move and fit around such tubular components T (e.g. move in direction M as shown in FIG. 30). Then, once the support structure 20 is sufficiently placed around the tubular components T, first and second sections 120*a*, 120*b* are pivoted to fully close around said tubular components T, and thereby also providing full functionality of the support unit and/or compact snubbing or push/pull unit (e.g. see FIG. 36). In another embodiment (not shown), first and second sections 120*a*, 120*b* of the support structure 20 are not pivotally connected and can simply be maneuvered independently to be placed around tubular components T as desired. Even more advantageously, by pivoting (instead of simply have two separate first and second sections 120*a*, 120*b* of the support structure 20 and associated sections of snubbing unit), a single operator can usually manipulate the support structure 20 (and snubbing unit) on his own between an open (e.g. FIG. 30) and a closed (e.g. FIG. 36) configuration; e.g. such as by shuffling the hinged device along the rig floor RF and around the tubular components T.

Preferably, and as illustrated in the embodiment of FIGS. 29-40, a hydraulic ram-based actuator 80 is provided to pivot first and second sections 120*a*, 120*b*, so as to actuate the support unit 20 between the open (e.g. FIG. 30) and the closed (e.g. FIG. 36) configuration. Actuator 80 preferably comprises hydraulic ram 82, a first linkage member 84 to operably connect actuator 80 to the first section 120*a* and a second linkage member 86 to operably connect the actuator 80 to the second section 120*b* (e.g., see FIG. 30). As ram 82 is actuated between a retracted and an extended position (see FIGS. 30 and 36, respectively), the first and second section 120*a*, 120*b* are moved about hinge 60 (at pivot point P) so as to move the support unit 20 between the open (FIG. 30) and a closed (FIG. 36) configurations.

Figure 41:
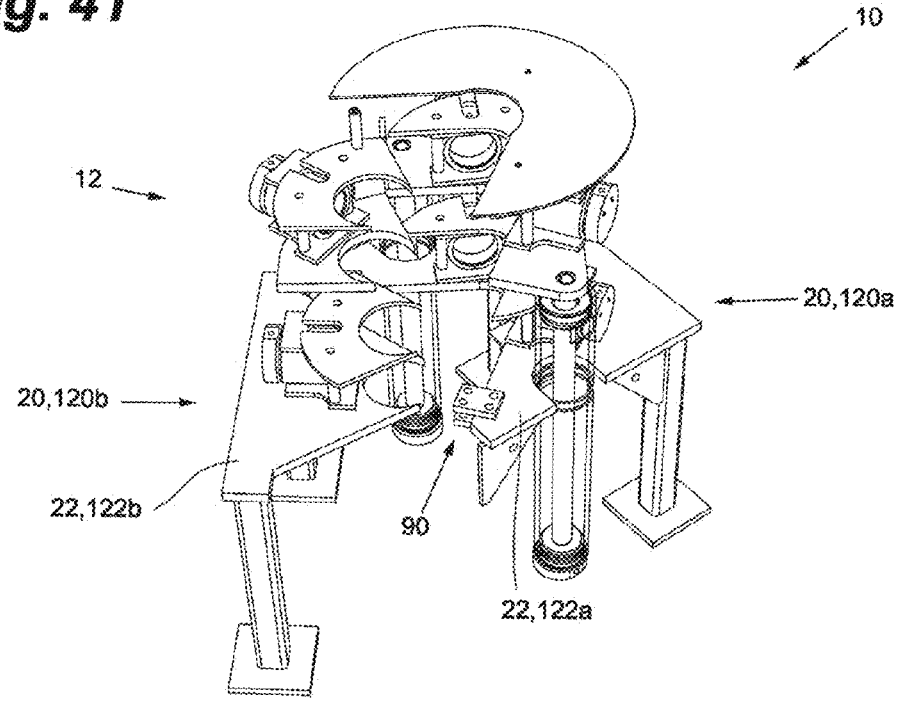
FIGS. 41-43 are various perspective views of a third embodiment of the invention.
Figure 42:
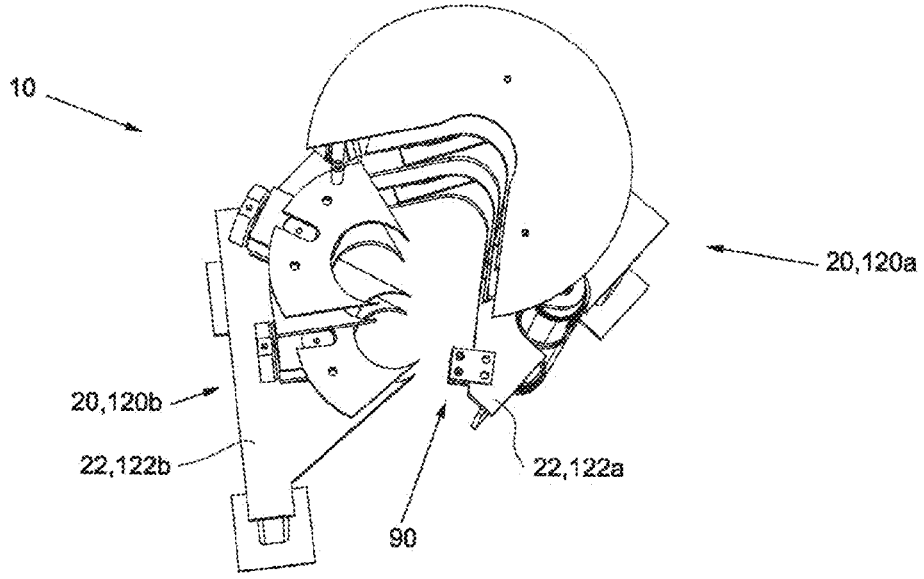
Figure 43:
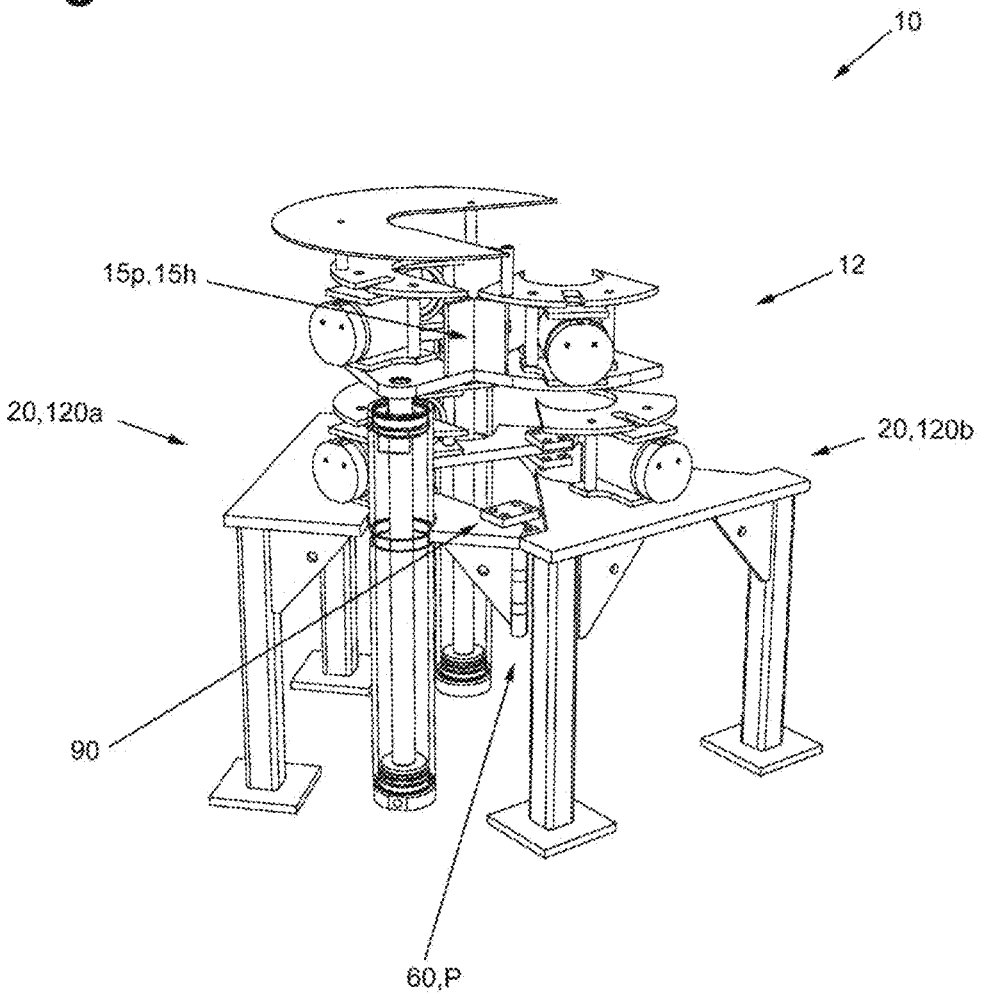

Preferably, and as illustrated in the embodiment of FIGS. 41-43, one or more bolt-down connector plates 90 are provided to enable an operator to securely fasten first and second sections 120*a*, 120*b* together, when the support unit 20 is in a closed configuration. More preferably, connector plates 90 comprise a plurality of bolt holes which can align with corresponding bolt holes (not show) in the relevant section of the support plate 22, thereby allowing bolts to be placed therethrough (i.e. through both the connector 90 and the relevant sections 22, 122*a*, 122*b* of support plate). Even more preferably, similar connector plates (not shown) are provided to securely fasten various components of the first and second sections 112*a*, 112*b* of the snubbing unit or push/pull unit 12 together (such as on relevant sections of traveling plate 14*t*, 114*ta*, 114*tb* or stationary plate 15*s*, 115*sa*, 115*sb*). Advantageously, such connector plates 90 for the support unit 20 and/or for the snubbing or push/pull unit 12, along with hinge 60, provide structural support to these embodiments of the support structure 20 and thereby provide an additional safety factor during operation (i.e. to securely keep the respective first and second sections together). More advantageously, connector plates 90 and appropriately aligned bolt holes and bolts therethrough could also act as a hinge 60 if so desired.

Unless otherwise specified, it is preferred that the components of the invention be made of steel or other suitable high-strength materials capable of taking stresses and strains during its intended use during well operations.

Those of ordinary skill in the art will appreciate that various modifications to the invention as described herein will be possible without falling outside the scope of the invention.

The embodiments of the invention in which an exclusive property or privilege is being claimed are defined as follows:

1. A support structure for use on a rig floor and for supporting a unit used to manipulate tubular components through a wellhead, comprising:

a first section;

a second section;

a first leg and a second leg projecting from the first section;

a third leg projecting from the second section; and a central passage of sufficient diameter to allow passage of the tubular components therethrough;

wherein, when the first section and the second section are assembled together, said sections together are suitable to support said unit used to manipulate tubular components through a wellhead;

wherein, when the first section and the second section are assembled together, said first leg, second leg and third leg support said unit used to manipulate tubular components through a well head in an upright manner on the rig floor;

wherein the first section of the support structure further comprises a first central passage recess which has an opening of sufficient dimensions to allow a tubular component to, at least, be partially placed into the first central passage recess;

wherein the second section of the support structure further comprises a second central passage recess which has an opening of sufficient dimensions to allow a tubular component to, at least, be partially placed into the second central passage recess;

wherein, when the first and second sections of the support unit are placed adjacent to each other, the first central passage recess and the second central passage recess together create said central passage; and wherein the first and second sections can be moved relative to each other so as to open up the central passage sufficiently to allow the support structure to move and fit around said tubular components.

2. The support structure of claim 1, wherein the first section and the second sections are connected together via a hinge at pivot point, to allow the first and second sections to pivot with respect to each other around a substantially vertical pivot axis.

3. The support structure of claim 2, further comprising a hydraulic ram-based actuator to pivot first and second sections, so as to actuate the support unit between an open and a closed configuration.

4. The support structure of claim 1, wherein the first section and the second sections can be positioned to so as to place the support unit in an open or a closed configuration, as may be desired, the support structure further comprising at least one bolt-down connector plate to enable an operator to securely fasten first and second sections together, when the support unit is in the closed configuration;

said at least one bolt-down connector plate comprising a plurality of bolt holes.

5. The support structure of claim 1, further comprising a first support plate section and a second support plate section.

6. The support structure of claim 1, wherein the unit used to manipulate tubular components through a wellhead comprises a first section and a second section; and wherein the first section of the support structure supports the first section of the unit used to manipulate tubular components through a wellhead, along with a first portion of the second section of the unit used to manipulate tubular components through a wellhead.

7. The support structure of claim 6, wherein second section of the support structure supports a second remaining portion of the unit used to manipulate tubular components through a wellhead.

8. A system for use on a rig to manipulate tubular components through a wellhead, the system comprising:

a unit used to manipulate tubular components through a wellhead, comprising a first section and a second section;

the support structure of claim 1 to support said unit used to manipulate tubular components through a wellhead at a position above the rig's floor;

wherein the first section of the support structure supports the first section of the unit used to manipulate tubular components through a wellhead, along with a first portion of the second section of the unit used to manipulate tubular components through a wellhead;

wherein the unit used to manipulate tubular components through a wellhead further comprises a stationary slip assembly having a first section and a second section;

wherein the first and second sections of the stationary slip assembly are each, respectively, mounted to the first and second sections of the support structure; and wherein the unit used to manipulate tubular components through a wellhead further comprises a traveling slip assembly having a first section and a second section pivotally connected to each other at a pivot point.

9. The support structure of claim 8, wherein second section of the support structure supports a second remaining portion of the unit used to manipulate tubular components through a wellhead.

10. The support structure of claim 1, wherein the first section further comprises at least two ram passages to allow passage of jacking rams therethrough.

11. A support structure for use on a rig floor and for supporting a unit used to manipulate tubular components through a wellhead, comprising:

a first section;

a second section;

a first leg and a second leg projecting from the first section;

a third leg and a forth leg projecting from the second section;

a hinge; and a central passage of sufficient diameter to allow passage of the tubular components therethrough;

wherein, when the first section and the second section are assembled together, said sections together are suitable to support said unit used to manipulate tubular components through a wellhead;

wherein, when the first section and the second section are assembled together, said first leg, second leg, third leg and fourth leg support said unit used to manipulate tubular components through a well head in an upright manner on the rig floor;

wherein the first section of the support structure further comprises a first central passage recess which has an opening of sufficient dimensions to allow a tubular component to, at least, be partially placed into the first central passage recess;

wherein the second section of the support structure further comprises a second central passage recess which has an opening of sufficient dimensions to allow a tubular component to, at least, be partially placed into the second central passage recess;

wherein, when the first and second sections of the support unit are placed adjacent to each other, the first central passage recess and the second central passage recess together create said central passage;

wherein the first section and the second sections are connected together via the hinge at a pivot point, to allow the first and second sections to pivot with respect to each other around a substantially vertical pivot axis;

wherein the first and second sections can pivot about said vertical axis so as to open up the central passage sufficiently to allow the support structure to move and fit around said tubular components.

12. The support structure of claim 11 further comprising a hydraulic ram-based actuator to pivot first and second sections, so as to actuate the support unit between an open and a closed configuration;

wherein said hydraulic ram-based actuator is mounted between said first section and said second section.

13. The support structure of claim 11, wherein the first section further comprises at least two ram passages to allow passage of jacking rams therethrough.

14. The support structure of claim 11, wherein the first section further comprises at least one ram passage to allow passage of jacking rams therethrough; and wherein the second section further comprises at least one ram passage to allow passage of jacking rams therethrough.

15. A support structure, for use on a rig floor and for supporting a unit used to manipulate tubular components through a wellhead, comprising:

a first section;

a second section;

a first leg and a second leg projecting from the first section;

a third leg projecting from the second section; and a central passage of sufficient diameter to allow passage of the tubular components therethrough;

wherein, when the first section and the second section are assembled together, said sections together are suitable to support said unit used to manipulate tubular components through a wellhead;

wherein, when the first section and the second section are assembled together, said first leg, second leg and third leg support said unit used to manipulate tubular components through a well head in an upright manner on the rig floor;

wherein the first section further comprises at least one ram passage to allow passage of jacking rams therethrough; and wherein the second section further comprises at least one ram passage to allow passage of jacking rams therethrough.

* * * * *